US008379490B2

(12) United States Patent
Abe et al.

(10) Patent No.: US 8,379,490 B2
(45) Date of Patent: Feb. 19, 2013

(54) TIME INFORMATION-ACQUIRING APPARATUS AND RADIO WAVE TIMEPIECE

(75) Inventors: Hideo Abe, Tokorozawa (JP); Keiichi Nomura, Uenohara (JP)

(73) Assignee: Casio Computer Co., Ltd., Tokyo (JP)

( * ) Notice: Subject to any disclaimer, the term of this patent is extended or adjusted under 35 U.S.C. 154(b) by 322 days.

(21) Appl. No.: 12/892,021

(22) Filed: Sep. 28, 2010

(65) Prior Publication Data

US 2011/0075523 A1 Mar. 31, 2011

(30) Foreign Application Priority Data

Sep. 29, 2009 (JP) ..... 2009-224214

(51) Int. Cl.
*G04C 11/02* (2006.01)

(52) U.S. Cl. ..... 368/47

(58) Field of Classification Search ..... 368/46, 368/47; 375/354, 142, 149
See application file for complete search history.

(56) References Cited

U.S. PATENT DOCUMENTS 7,042,808 B2 * 5/2006 Saitoh ..... 368/47
7,133,424 B2 * 11/2006 Becker et al. ..... 370/514
2005/0195690 A1 * 9/2005 Kondo ..... 368/47
2006/0067166 A1 * 3/2006 Murata et al. ..... 368/47
2009/0231962 A1 * 9/2009 Someya ..... 368/47
2009/0248357 A1 * 10/2009 Abe ..... 702/176
2010/0008192 A1 * 1/2010 Abe ..... 368/47
2010/0014388 A1 * 1/2010 Abe ..... 368/47

FOREIGN PATENT DOCUMENTS

JP 2005249632 9/2005

* cited by examiner

*Primary Examiner* — Vit W Miska

(74) *Attorney, Agent, or Firm* — Turocy & Watson, LLP

(57) ABSTRACT

A time information-acquiring apparatus comprises a receiver receiving a standard time radio wave, an input waveform generator sampling a signal output from the receiver and to generating input waveform data with one or more unit time lengths, the input waveform data at each sampling point having a first value indicating a low level or a second value, the input waveform data within a first characteristic section having a predetermined value unique to codes forming a time code included in the standard time radio wave, an accumulator accumulating the value of the input waveform data during the first characteristic section, a calculator multiplying the accumulated value by characteristic values, and calculating correlation values between the input waveform data and the codes based on multiplied values.

20 Claims, 21 Drawing Sheets

(0 : JJY)

(1 : JJY)

(P : JJY)

(0 : WWVB)

(1 : WWVB)

(P : WWVB)

(A=0, B=0 : MSF)

(A=0, B=1 : MSF)

(A=1, B=0 : MSF)

(A=1, B=1 : MSF)

(M : MSF)

TIME INFORMATION-ACQUIRING APPARATUS AND RADIO WAVE TIMEPIECE

CROSS-REFERENCE TO RELATED APPLICATIONS

This application is based upon and claims the benefit of priority from prior Japanese Patent Application No. 2009-224214, filed Sep. 29, 2009, the entire contents of which are incorporated herein by reference.

BACKGROUND OF THE INVENTION

1. Field of the Invention

The present invention relates to a time information-acquiring apparatus that receives a standard time radio wave and acquires the time information thereof and a radio wave timepiece comprising the time information-acquiring apparatus.

2. Description of the Related Art

In recent years, for example, in Japan, Germany, England, and Switzerland, transmitting stations transmit a standard time radio wave of a low frequency. For example, transmitting stations in Fukushima and Saga in Japan transmit amplitude-modulated standard time radio waves of 40 kHz and 60 kHz, respectively. The standard time radio wave includes a code string forming a time code indicating the date and time and is transmitted every 60 seconds. That is, the period of the time code is 60 seconds.

A clock (radio wave timepiece) that receives a standard time radio wave including a time code, extracts the time code from the received standard time radio wave, and corrects the time has been put to practical use. A receiver of the radio wave timepiece includes a band-pass filter (BPF) that receives the standard time radio wave through an antenna and extracts only a standard time radio wave signal, a demodulator that demodulates an amplitude-modulated standard time radio wave signal using, for example, envelope detection, and a processor that reads a time code included in the signal demodulated by the demodulator.

The processor according to the prior art is synchronized with the rising edge of the demodulated signal and performs binarization with a predetermined sampling period to acquire time code output (TCO) data with a unit time length (one second), which is a binary bit string. The processor measures the pulse width (that is, the time of a bit 1 or the time of a bit 0) of the TCO data, determines any one of a marker M code, a position marker code, a binary 0 code, and a binary 1 code based on the measured pulse width, and acquires time information based on the determined code string.

The processor according to the prior art performs processes, such as a second synchronization process, a minute synchronization process, a process of acquiring a code, and a process of determining matching, during the period from the start of the reception of the standard time radio wave to the acquisition of the time information. When each of the processes is not appropriately terminated, the processor needs to start the processes from the beginning. Therefore, in some cases, the processor sometimes needs to start the processes from the beginning several times due to the influence of noise included in the signal. For such instances, it takes a very long time to acquire time information.

The second synchronization detects the rising edge of a code at an interval of one second among the codes indicated by the TCO data. It is possible to detect a portion in which a position marker P0 arranged at the end of a frame and a marker M arranged at the head of the frame are continuously arranged by repeatedly performing the second synchronization. The portion in which the marks are continuously arranged appears at an interval of one minute (60 seconds). Within the TCO data, the marker M shows the position of the head frame data. The detection of the position of the marker is referred to as minute synchronization. The head of the frame is recognized by the minute synchronization. Therefore, after code acquisition starts to acquire one frame of data, a parity bit is checked to determine whether the data has an improper value (the date and time have improper values) (matching determination). For example, since the minute synchronization is for detecting the head of the frame, 60 seconds are required in some cases. Of course, multiples of 60 seconds are required to detect the heads of several frames.

In Jpn. Pat. Appln. KOKAI Publication No. 2005-249632 (corresponding to US 2005/0195690 A1), the demodulated signal is binarized at a predetermined sampling interval (50 ms) to obtain TCO data and a list of data groups comprising binary bit strings is obtained every one second (20 samples). The apparatus disclosed in Jpn. Pat. Appln. KOKAI Publication No. 2005-249632 compares the bit string with the templates of binary bit strings indicating a marker code M, a position marker code, a code 1, and a code 0, calculates a correlation therebetween, and determines which of the marker code M, the position marker code P, a binary 1 code, and a binary 0 code corresponds to the bit string.

In the technique disclosed in Jpn. Pat. Appln. KOKAI Publication No. 2005-249632, the TCO data, which is a binary bit string, is acquired and matched with the template. When the field intensity is weak or a large amount of noise is mixed with the demodulated signal, many errors are included in the acquired TCO data. Therefore, it is necessary to provide a filter which removes noise from the demodulated signal or to finely adjust the threshold of an AD converter, in order to improve the quality of the TCO data.

The process of determining which of the marker code M, the position marker code P, the binary 1 code, and the binary 0 code corresponds to data with a unit time length (one second) is insufficient to detect the head of the second or the head of the minute, and it is necessary to perform the determining process again based on the determination result. When the head of the second or the head of the minute is not appropriately detected, it is necessary to perform the process again.

BRIEF SUMMARY OF THE INVENTION

An object of the invention is to provide a time information-acquiring apparatus capable of accurately acquiring a code included in a standard time radio wave to obtain the current time while reducing the amount of calculation and the calculation time, without being affected by the field intensity or the noise of signals and a radio wave timepiece including the time information-acquiring apparatus.

According to an embodiment of the present invention, a time information-acquiring apparatus comprises:

a receiver configured to receive a standard time radio wave including a time code;

an input waveform generator configured to sample a signal output from the receiver and including the time code with a predetermined sampling period and to generate input waveform data with one or more unit time lengths, the input waveform data at each sampling point having one of a first value indicating a low level and a second value indicating a high level, the input waveform data within a first characteristic section having a predetermined value unique to codes forming time information included in the time code;

an accumulator configured to accumulate the predetermined value of the input waveform data during the first characteristic section and to store an accumulated value;

a calculator configured to perform an arithmetic calculation for the accumulated value stored by the accumulator and characteristic values, which are one of the first value and the second value, of the first characteristic section of the codes forming the time information included in the time code, and to calculate correlation values between the input waveform data and the codes forming the time information based on a result of the arithmetic calculation;

a comparator configured to compare the correlation values calculated by the calculator and to determine an optimal value of the correlation values; and a controller configured to acquire the time information included in the time code based on a code related to the optimal value.

Additional objects and advantages of the present invention will be set forth in the description which follows, and in part will be obvious from the description, or may be learned by practice of the present invention.

The objects and advantages of the present invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the present invention and, together with the general description given above and the detailed description of the embodiments given below, serve to explain the principles of the present invention.

FIGS. 8A, 8B, 80, 8D, and 8E are diagrams illustrating examples of codes in the MSF standard;

DETAILED DESCRIPTION OF THE INVENTION

Hereinafter, exemplary embodiments of the invention will be described with reference to the accompanying drawings. In an embodiment of the invention, a time information-acquiring apparatus is provided in a radio wave timepiece that receives a standard time radio wave in a long wavelength band, detects the signal thereof, extracts a code string indicating a time code in the signal, and corrects time based on the code string.

In recent years, for example, in Japan, Germany, England, and Switzerland, a standard time radio wave is transmitted from a predetermined transmitting station. For example, transmitting stations in Fukushima and Saga in Japan transmit amplitude-modulated standard time radio waves of 40 kHz and 60 kHz, respectively. The standard time radio wave includes a code string forming a time code indicating the date and time and is transmitted with a period of 60 seconds. Since one code has a unit time length (one second), one period may include 60 codes.

Figure 1:
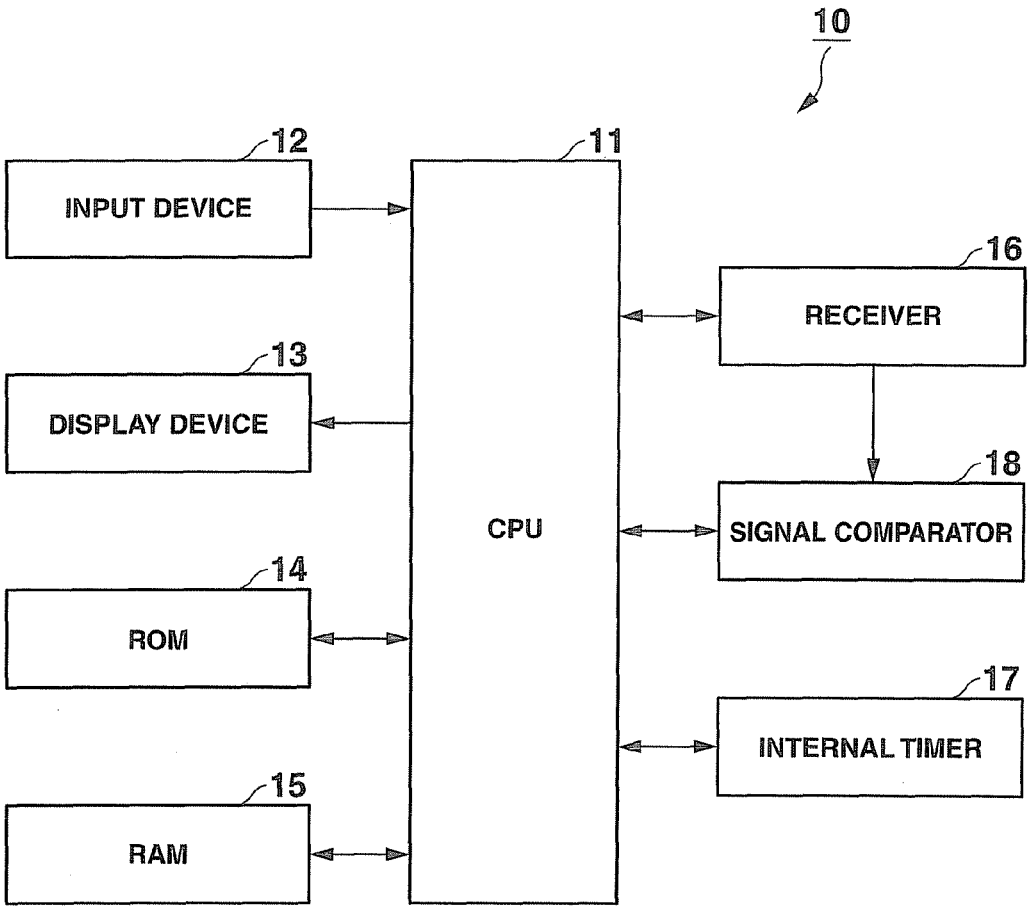
FIG. 1 is a block diagram illustrating the structure of a radio wave timepiece according to an embodiment of the invention.

FIG. 1 is a block diagram illustrating the structure of the radio wave timepiece according to this embodiment. As shown in FIG. 1, a radio wave timepiece 10 comprises a CPU 11 (a control unit and a time correcting unit), an input device 12, a display device 13 (time display device), a ROM 14, a RAM 15, a receiver 16 (receiving unit), an internal timer 17 (internal timer), and a signal comparator 18.

The CPU 11 reads a program stored in the ROM 14 at predetermined timing or in response to an operation signal input from the input device 12, expands the read program in the RAM 15, and transmits instructions or data to each unit or device of the radio wave timepiece 10 based on the program. Specifically, for example, the CPU 11 performs a process of controlling the receiver 16 to receive a standard time radio wave at predetermined time intervals, specifying a code string included in the standard time radio wave signal from digital data based on the signal obtained from the receiver 16, and correcting the current time measured by the internal timer 17 based on the code string, or a process of transmitting the current time measured by the internal timer 17 to the display device 13. In this embodiment, predicted waveform data of a standard time radio wave signal with one or more unit time lengths and a predetermined format is generated, and the predicted waveform data is compared with input waveform data which is obtained from the standard time radio wave received by the receiver to specify the head of the second.

In addition, in this embodiment, predicted waveform data including a predetermined code with one or more unit time lengths is generated to specify the head of the minute. In this embodiment, a value (product) obtained by multiplying the accumulated value of the data value in a predetermined section (characteristic section) of the input waveform data by a multiplier of the predicted waveform data is used to specify various kinds of code values including hour, minute, year, month, and day codes. When the year, month, day, hour, and minute are specified, an error of the internal timer 17 is calculated, and it is possible to correct the current time of the internal timer 17.

The input device 12 includes a switch that instructs the radio wave timepiece 10 to perform various kinds of functions. When the switch is operated, a corresponding operation signal is output to the CPU 11. The display device 13 includes a dial, an analog pointer mechanism controlled by the CPU 11, and a liquid crystal panel and displays the current time measured by the internal timer 17. The ROM 14 stores, for example, a system program or an application program for operating the radio wave timepiece 10 and implementing a predetermined function. The programs that implement the predetermined function also include a program for controlling the signal comparator 18 in order to perform a process of detecting a second pulse position, a process of detecting a minute head position, and a code decoding process, which will be described below. The RAM 15 is used as a work area of the CPU 11 and temporarily stores, for example, the program or data read from the ROM 14 and data processed by the CPU 11.

The receiver 16 includes, for example, an antenna circuit or a detector. The receiver 16 obtains a demodulated signal from the standard time radio wave received by the antenna circuit and outputs the signal to the signal comparator 18. The internal timer 17 includes an oscillating circuit. The internal timer 17 counts clock signals output from the oscillating circuit to measure the current time and outputs data of the current time to the CPU 11.

Figure 2:
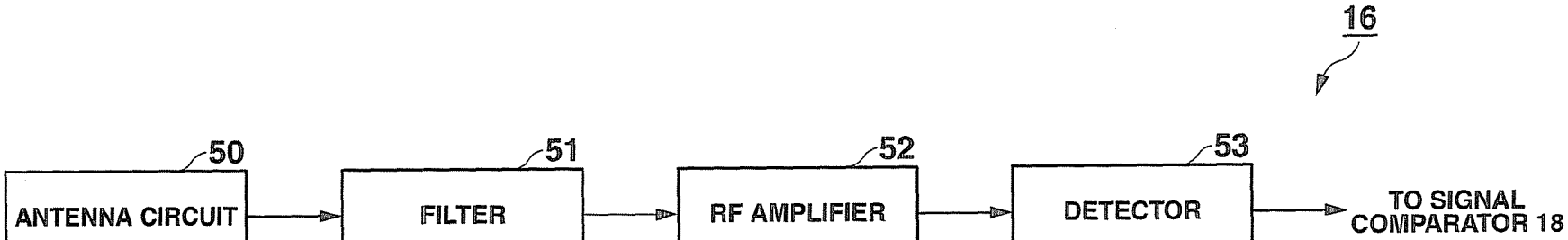
FIG. 2 is a block diagram illustrating an example of the structure of a receiver according to this embodiment.

FIG. 2 is a block diagram illustrating an example of the structure of the receiver according to this embodiment. As shown in FIG. 2, the receiver 16 comprises an antenna circuit 50 that receives a standard time radio wave, a filter 51 that removes noise from the signal of the standard time radio wave (standard time radio wave signal) received by the antenna circuit 50, an RF amplifier 52 that amplifies a high frequency signal, which is the output of the filter 51, and a detector 53 that detects a signal output from the RF amplifier 52 and demodulates the standard time radio wave signal. The signal demodulated by the detector 53 is output to the signal comparator 18.

Figure 3:
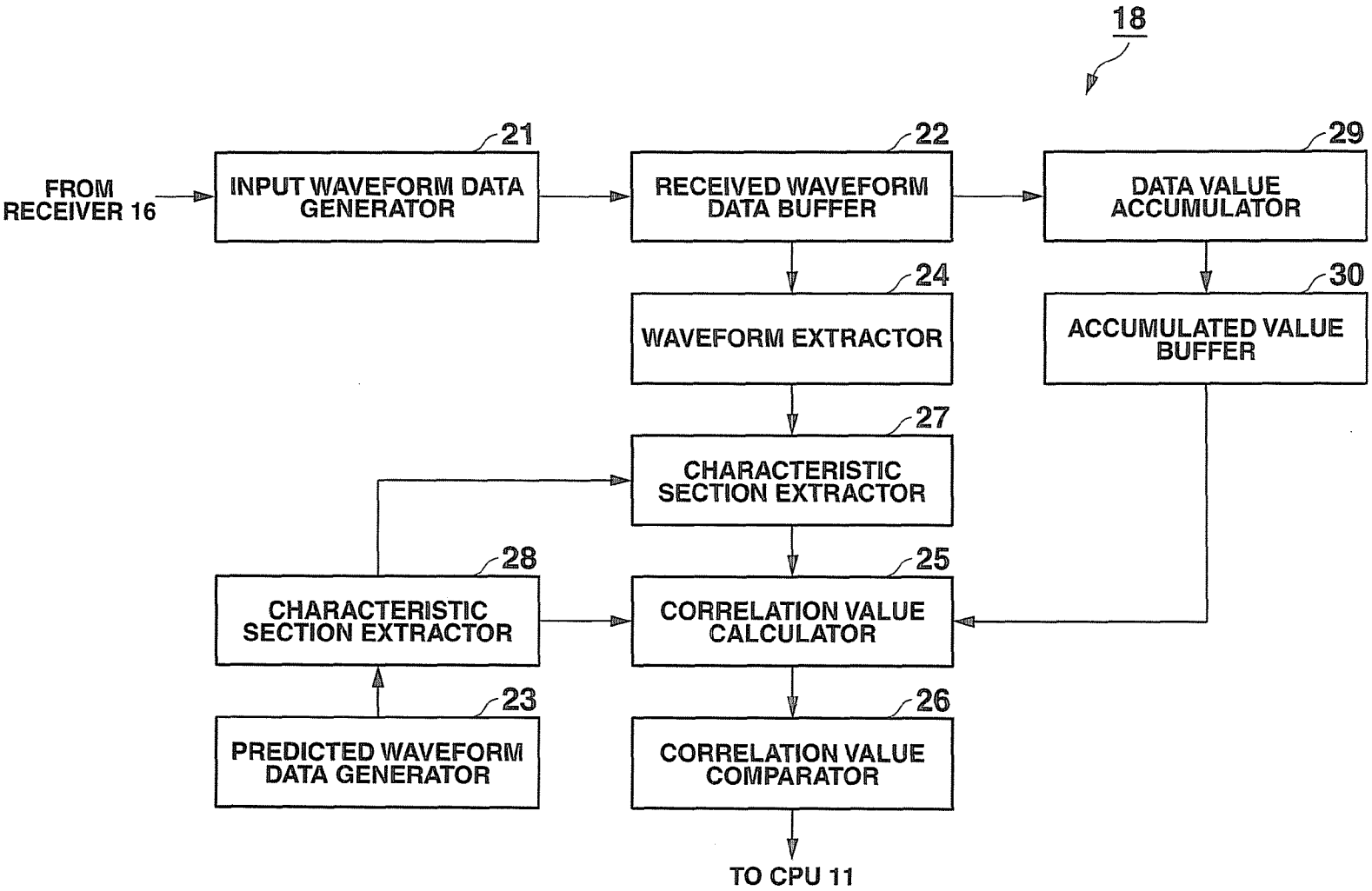
FIG. 3 is a block diagram illustrating the structure of a signal comparator according to this embodiment.

FIG. 3 is a block diagram illustrating the structure of the signal comparator according to this embodiment. As shown in FIG. 3, the signal comparator 18 according to this embodiment comprises an input waveform data generator 21, a received waveform data buffer 22, a predicted waveform data generator 23, a waveform extractor 24, a correlation value calculator 25, a correlation value comparator 26, characteristic section extractors 27 and 28, a data value accumulator 29, and an accumulated value buffer 30 (accumulated value storage unit).

The input waveform data generator 21 converts the signal output from the receiver 16 into digital data having any one of plural values at predetermined sampling intervals and outputs the converted digital data. For example, the sampling interval is 50 ms and data of 20 samples per second may be acquired. The value of the digital data according to this embodiment will be described below. The received waveform data buffer 22 sequentially stores data generated by the input waveform data generator 21. The received waveform data buffer 22 may store data of plural unit time lengths (for example, 10 unit time lengths (10 seconds)) when the unit time length is one second. When new data is stored, the old data is removed in chronological order.

The predicted waveform data generator 23 generates predicted waveform data, which is a comparison target, with a predetermined time length. For example, the predicted waveform data is used in a process of detecting a second pulse position and a process of detecting a minute head position, which will be described below. The predicted waveform data generated by the predicted waveform data generator 23 will be described in detail in each detecting process. The waveform extractor 24 extracts input waveform data with the same time length as that of the predicted waveform data from the received waveform data buffer 22.

The correlation value calculator 25 calculates a correlation value between each of plural items of predicted waveform data and the input waveform data item. In addition, the correlation value calculator 25 calculates a correlation value between the accumulated value stored in the accumulated value buffer 30 and the multiplied value of the data values of the predicted waveform data in a code decoding process. In this embodiment, covariance is used for correlation, which will be described below in detail. The correlation value comparator 26 compares the correlation values (covariance values) calculated by the correlation value calculator 25 to specify the optimal value thereof.

In this embodiment, in the process of detecting the minute head position, the data values (characteristic values) only in the corresponding predetermined sections (characteristic section) of both the input waveform data and the predicted waveform data are used for calculation. The characteristic section is determined by the kind of code of the predicted waveform data. The characteristic section extractor 28 extracts the characteristic value of the characteristic section in the predicted waveform data according to the kind of code of the predicted waveform data. The characteristic section extractor 27 extracts the data value of a section corresponding to the characteristic section extractor 28 in the input waveform data.

In this embodiment, when the process of detecting the minute head position is performed, a predetermined data value based on the input waveform data is acquired in advance in order to calculate the covariance value in the code decoding process. The data value accumulator 29 accumulates the data value used to calculate the covariance. The accumulated data value is temporarily stored in the accumulated value buffer 30.

Figure 4:
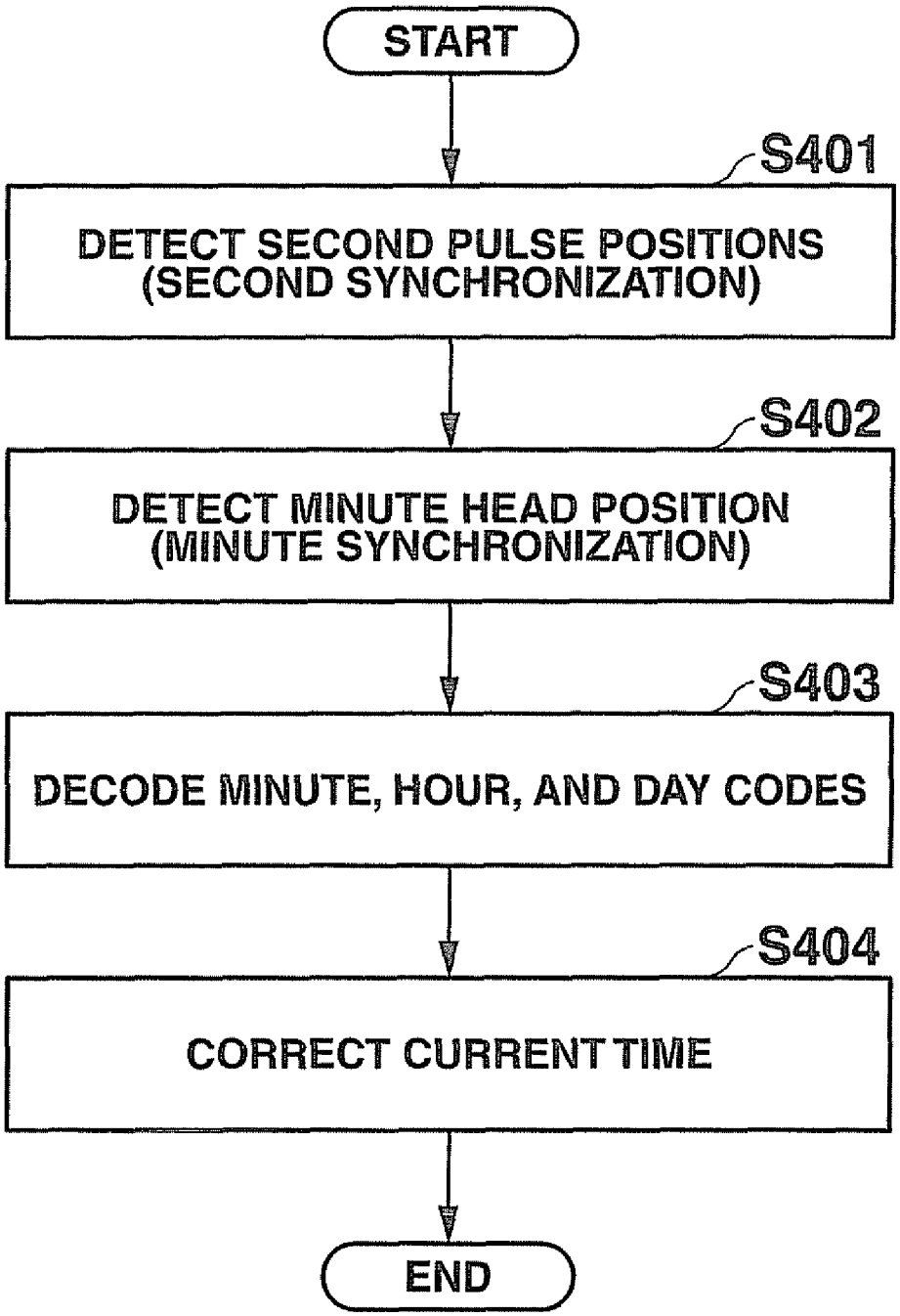
FIG. 4 is a flowchart schematically illustrating a process performed in the radio wave timepiece according to this embodiment.
Figure 5A:
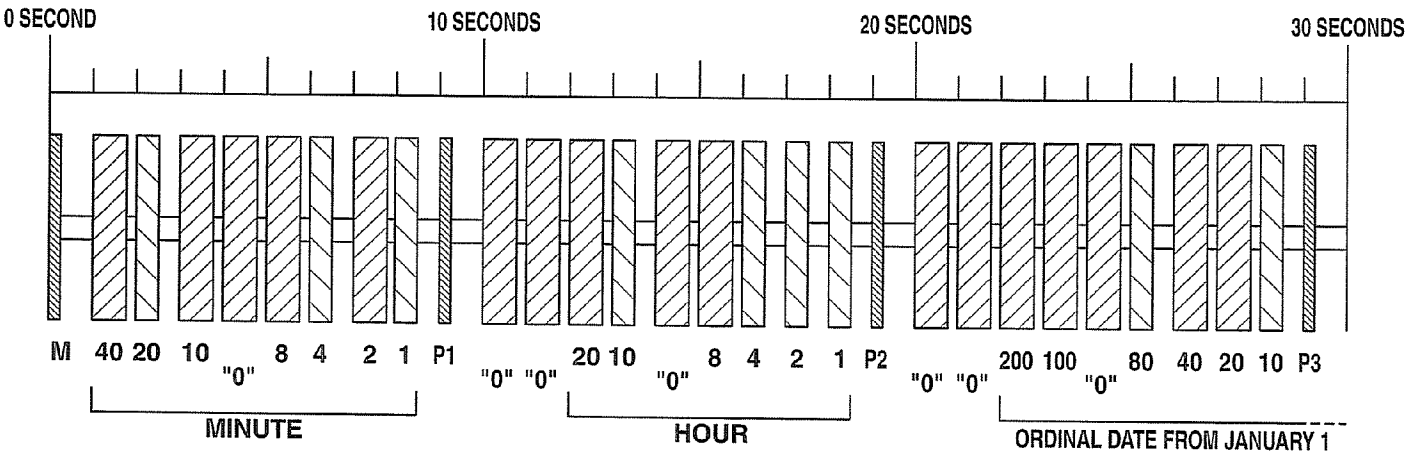
FIGS. 5A and 5B show are diagrams illustrating a standard time radio wave signal standard.
Figure 5B:
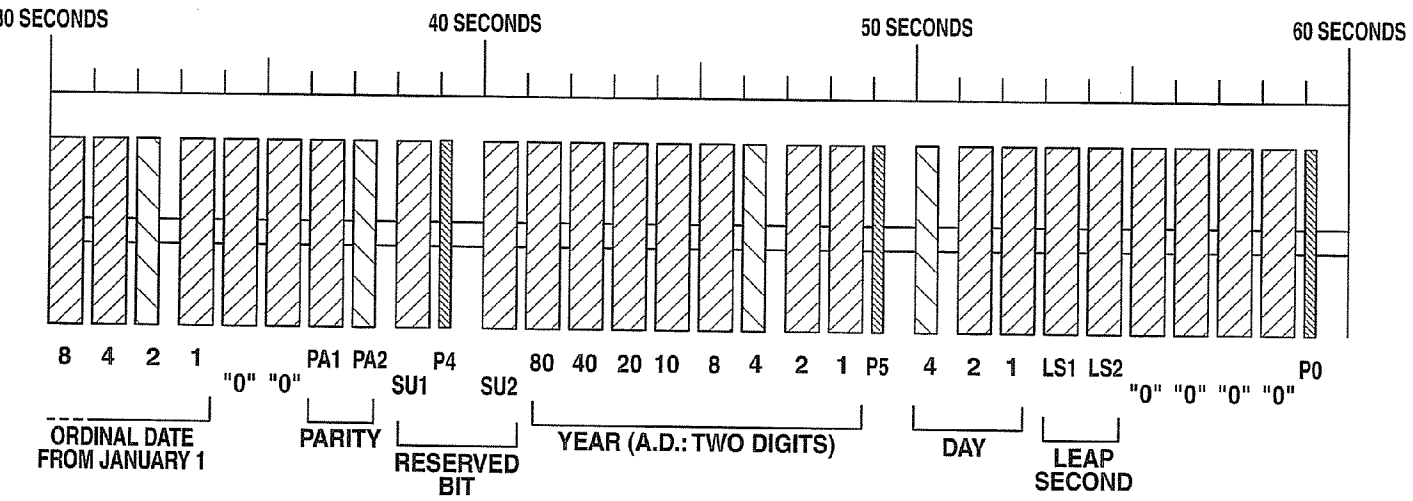

FIG. 4 is a flowchart schematically illustrating a process performed in the radio wave timepiece according to this embodiment. The process shown in FIG. 4 is mainly performed by the CPU 11 and the signal comparator 18 based on instructions from the CPU 11. As shown in FIG. 4, the CPU 11 and the signal comparator 18 (hereinafter, referred to as "CPU 11 and the like" for convenience of explanation) detect the second pulse position (Step S401). The process of detecting the second pulse position is also referred to as second synchronization. FIGS. 5A and 5B are diagrams illustrating a standard time radio wave signal standard. As shown in FIGS. 5A and 5B, the standard time radio wave signal is transmitted according to a predetermined standard. In the standard time radio wave signal, codes indicating M, P, 1, and 0 with a unit time length of 1 second are continuously arranged. In the standard time radio wave, one frame is 60 seconds and includes 60 codes. In addition, in the standard time radio wave, position markers P1, P2, . . . , and a marker M are arranged at an interval of ten seconds. It is possible to search the head of the frame (i.e. the head position of the minute) which is arranged at an interval of sixty seconds, by detecting a portion in which a position marker P0 arranged at the end of the frame and the marker M arranged at the head of the frame are continuously arranged.

Figure 6A:
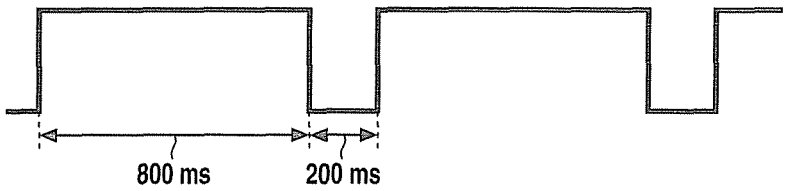
FIGS. 6A, 6B, and 6C are diagrams illustrating examples of codes in the JJY standard.
Figure 6B:
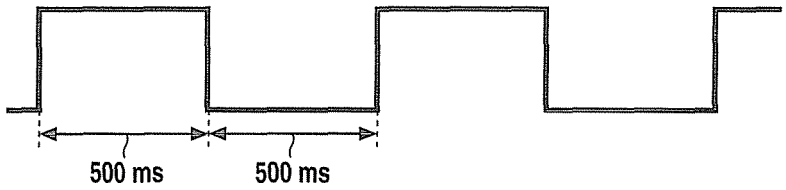
Figure 6C:
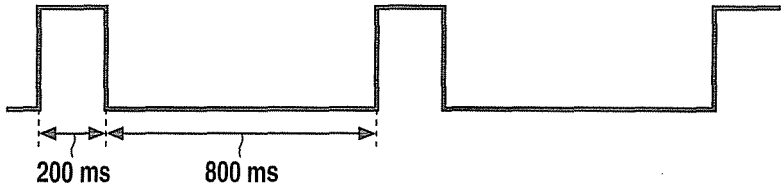

FIGS. 6A, 6B, and 6C are diagrams illustrating examples of codes 0, 1, and P in the JJY standard. In JJY, a code has a unit time length (one second) and changes from a low level to a high level at the head of the second. As shown in FIG. 6A, in JJY, the code 0 is at a high level during a first period of 800 ms and is at a low level during the next period of 200 ms. That is, the code 0 is a signal with an 80% duty. As shown in FIG. 6B, the code 1 is at a high level during a first period of 500 ms and is at a low level during the next period of 500 ms. That is, the code 1 is a signal with a 50% duty. As shown in FIG. 6C, the code P is used as the position marker or the marker and is at a high level during a first period of 200 ms and at a low level during the next period of 800 ms. That is, the code P is a signal with a 20% duty.

In this embodiment, in order to accurately detect the signal of JJY which changes from a low level to a high level at the head of the second, plural items of predicted waveform data are generated in which a predetermined number of waveform data items (for example, four items of data in this embodiment) each having a unit time length and a predetermined data value are continuously arranged and a phase of the plural items of predicted waveform data is shifted by a time interval of 50 ms. The covariance values between the plural items of predicted waveform data and the input waveform data are calculated and a changing point of the predicted waveform data which indicates the optimal covariance value from a low level to a high level is determined to be the second pulse position (the head position of the second).

Then, the CPU 11 and the like detect the head position of the minute, that is, the head position of one frame of the standard time radio wave signal (Step S402). The process of detecting the minute head position is also referred to as minute synchronization. Then, the CPU 11 and the like perform the code decoding process (Step S403). In Step S403, various kinds of codes (a code M1 indicating one's place of the minute, a code M10 indicating ten's place of the minute, and other codes indicating date or day) of the standard time radio wave signal are decoded based on the comparison between the predicted waveform data and the input waveform data.

Figure 7A:
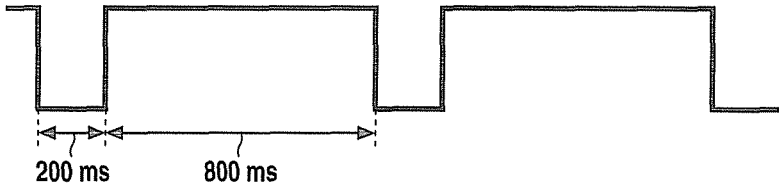
FIGS. 7A, 7B, and 7C are diagrams illustrating examples of codes in the WWVB standard.
Figure 7B:
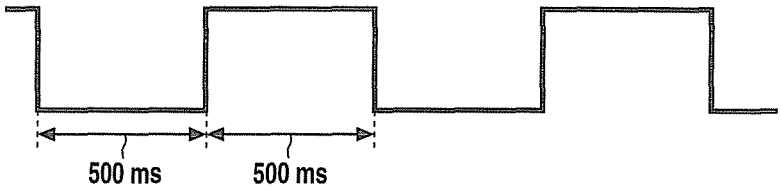
Figure 7C:
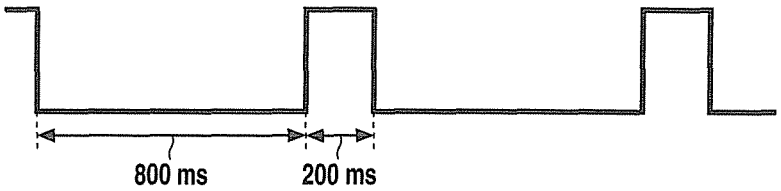

In this embodiment, the standard time radio wave signal of JJY is received and second synchronization is performed on the signal. However, this embodiment may be modified such that standard time radio wave signals based on other standards, for example, WWVB or MSF are received. Here, codes based on WWVB and MSF will be described briefly. FIGS. 7A, 7B, and 7C are diagrams illustrating codes 0, 1, and P included in WWVB used in US. In WWVB, a code changes from a high level to a low level at the head of the second. In WWVB, the code 0 is at a low level during a first period of 200 ms and is at a high level during the next period of 800 ms. The code 1 is at a low level during a first period of 500 ms and is at a high level at the next period of 500 ms. The code P is at a low level during a first period of 800 ms and is at a high level during the next period of 200 ms.

Figure 8A:
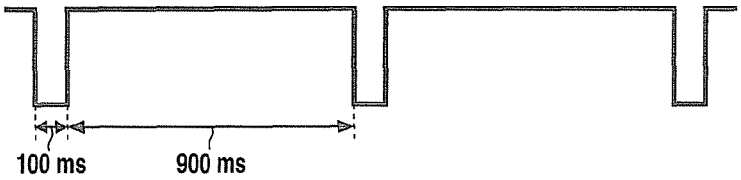
Figure 8B:
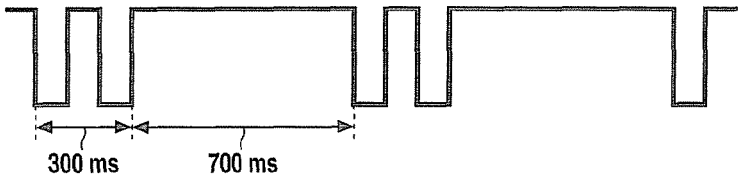
Figure 8C:
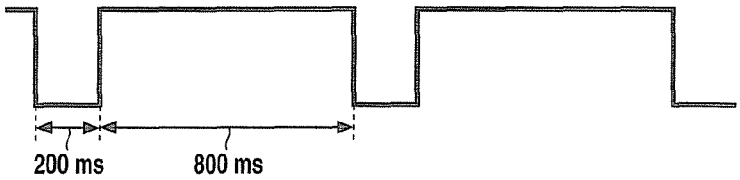
Figure 8D:
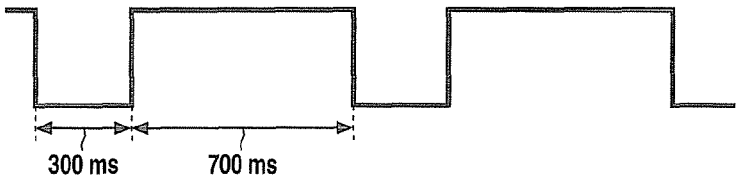
Figure 8E:
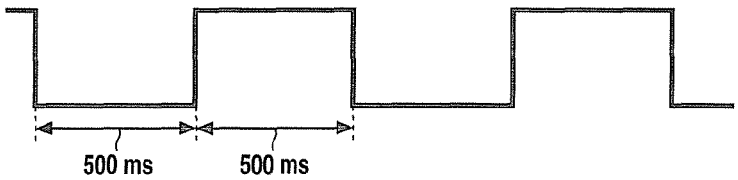

FIGS. 8A, 8B, 8C, 8D, and 8E are diagrams illustrating codes included in MSF used in England. MSF includes five codes, unlike JJY and WWVB, of which four codes may indicate values of two bits A and B. In MSF, the code changes from a high level to a low level at the head of the second. As shown in FIG. 8A, a code corresponding to A=0 and B=0 is at a low level during a first period of 100 ms and is at a high level during the next period of 900 ms. As shown in FIG. 8B, a code corresponding to A=0 and B=1 is sequentially at a low level, a high level, and a low level at an interval of 100 ms during a first period of 300 ms and is then at a high level during the next period of 700 ms. As shown in FIG. 8C, a code corresponding to A=1 and B=0 is at a low level during a first period of 200 ms and is at a low level during the next period of 800 ms. As shown in FIG. 8D, a code corresponding to A=1 and B=1 is at a low level during a first period of 300 ms and is at a high level during the next period of 700 ms. As shown in FIG. 8E, a code M corresponding to a marker is at a low level during a first period of 500 ms and is at a high level during the next period of 500 ms.

Figure 9:
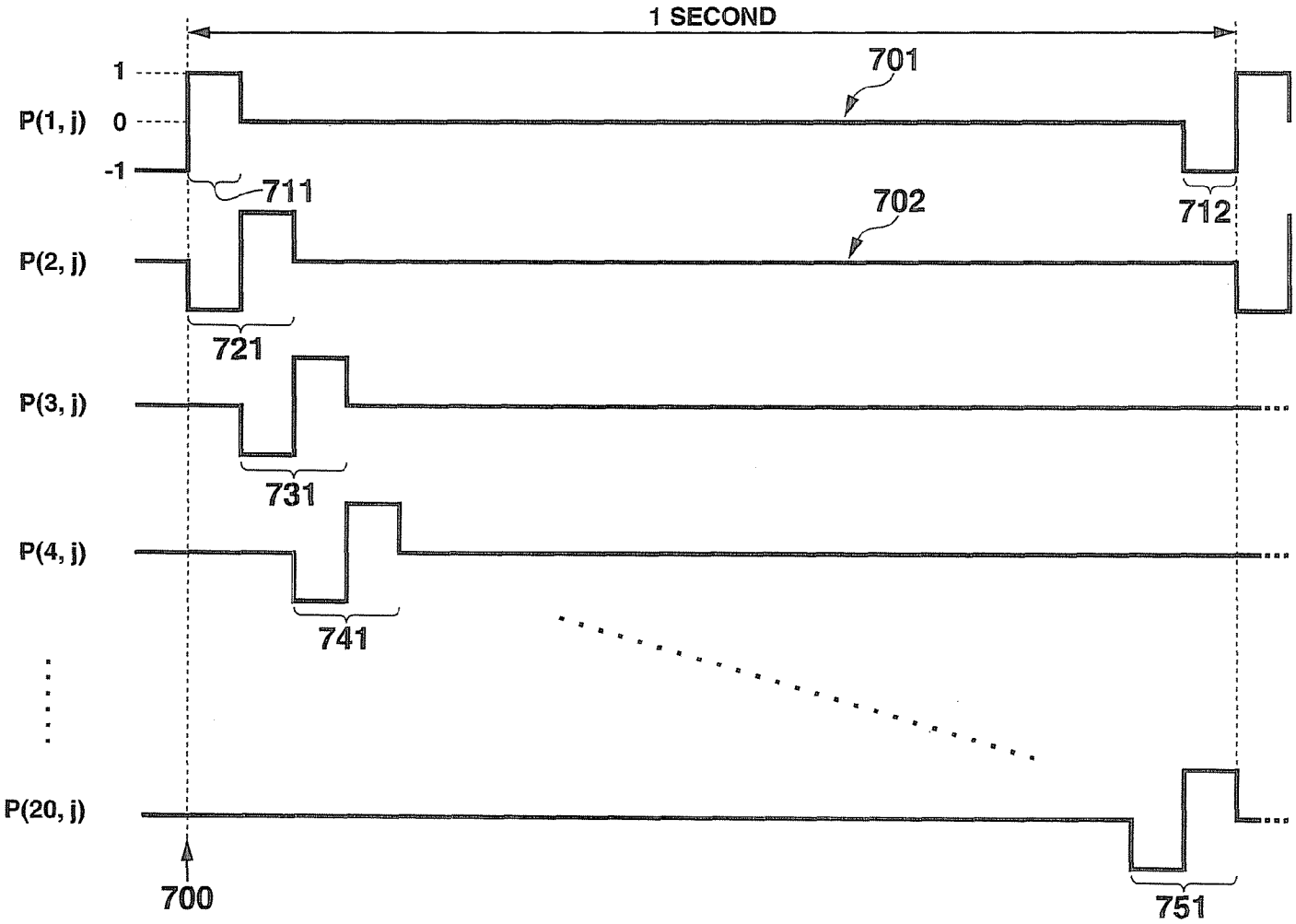
FIG. 9 is a diagram illustrating an example of a portion of predicted waveform data used in second synchronization according to this embodiment.

Next, the process of detecting the second pulse position (or the process of second synchronization) according to this embodiment (Step S401) will be described in more detail. FIG. 9 is a diagram illustrating an example of a portion of the predicted waveform data used in the second synchronization according to this embodiment. FIG. 9 shows the predicted waveform data items corresponding to one second, which is a first unit time length in each of the predicted waveform data items. A dashed line represented by reference numeral 700 indicates the head of the predicted waveform data. In this embodiment, actually, the predicted waveform data generator 23 generates predicted waveform data items with 4 unit time lengths, that is, predicted waveform data items corresponding to four seconds in which four predicted waveform data items each having a unit time length shown in FIG. 9 are continuously arranged. In this embodiment, the predicted waveform data generator 23 generates 20 predicted waveform data items P(1, j) to P(20, j) in which the heads of the data (change from a low level to a high level) are shifted by 50 ms.

As shown in FIG. 9, the first predicted waveform data item P(1, j) changes from a low level to a high level at the head of the data (see reference numeral 700). The predicted waveform data according to this embodiment has a first value indicating a low level in a predetermined section (temporally old side) before a point where the data changes from a low level to a high level (in the first predicted waveform data item, a point represented by reference numeral 700) and has a second value indicating a high level in a predetermined section (temporally new side) after the point. In addition, the predicted waveform data has a third value in sections other than the predetermined sections before and after the point. In the example shown in FIG. 9, −1 is used as the first value, 1 is used as the second value, and 0 is used as the third value. In this embodiment, each of the predetermined section with the first value indicating the low level and the predetermined section with the second value indicating the high level is 50 ms.

In the actual calculation, in a portion having the first value and a portion having the second value, that is, in the first predicted waveform data item P(1, j) (see reference numeral 701), only portions represented by reference numerals 711 and 712 are substantially valid in calculation. In the second predicted waveform data item P(2, j) to the twentieth predicted waveform data item P(20, j), only portions represented by reference numerals 721, 731, 741, . . . , and 751 are substantially valid in calculation.

As can be seen from FIG. 9, the second predicted waveform data item P(2, j) (see reference numeral 702) changes from a low level to a high level after a lapse of 50 ms from the head of the data. Hereinafter, the points where the third predicted waveform data item P(3, j), the fourth predicted waveform data item P(4, j), . . . , and so on change from a low level to a high level are sequentially arranged at intervals of 50 ms from the head of the data.

Figure 10:
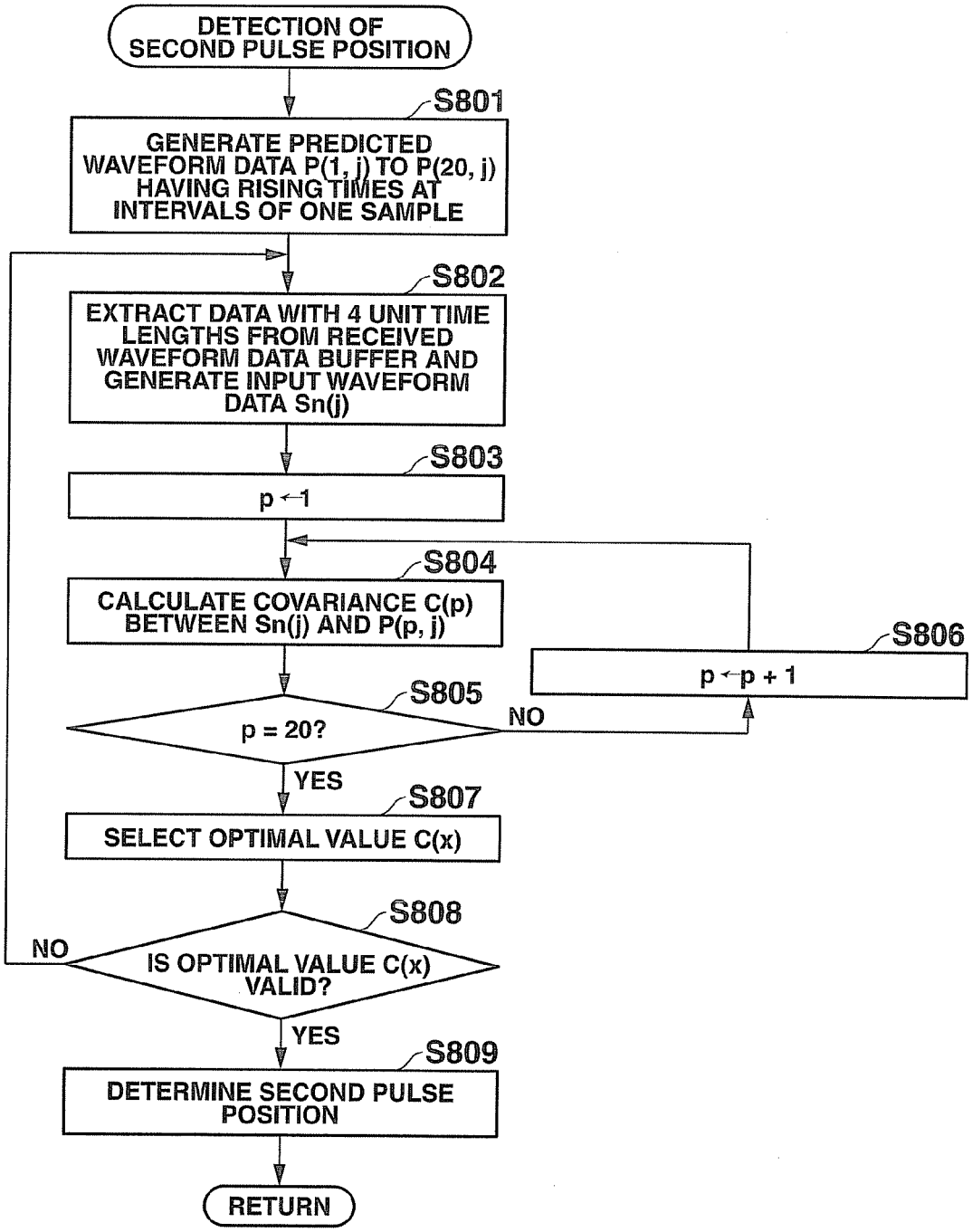
FIG. 10 is a flowchart illustrating the detection of a second pulse position (second synchronization) according to this embodiment in more detail.
Figure 11:
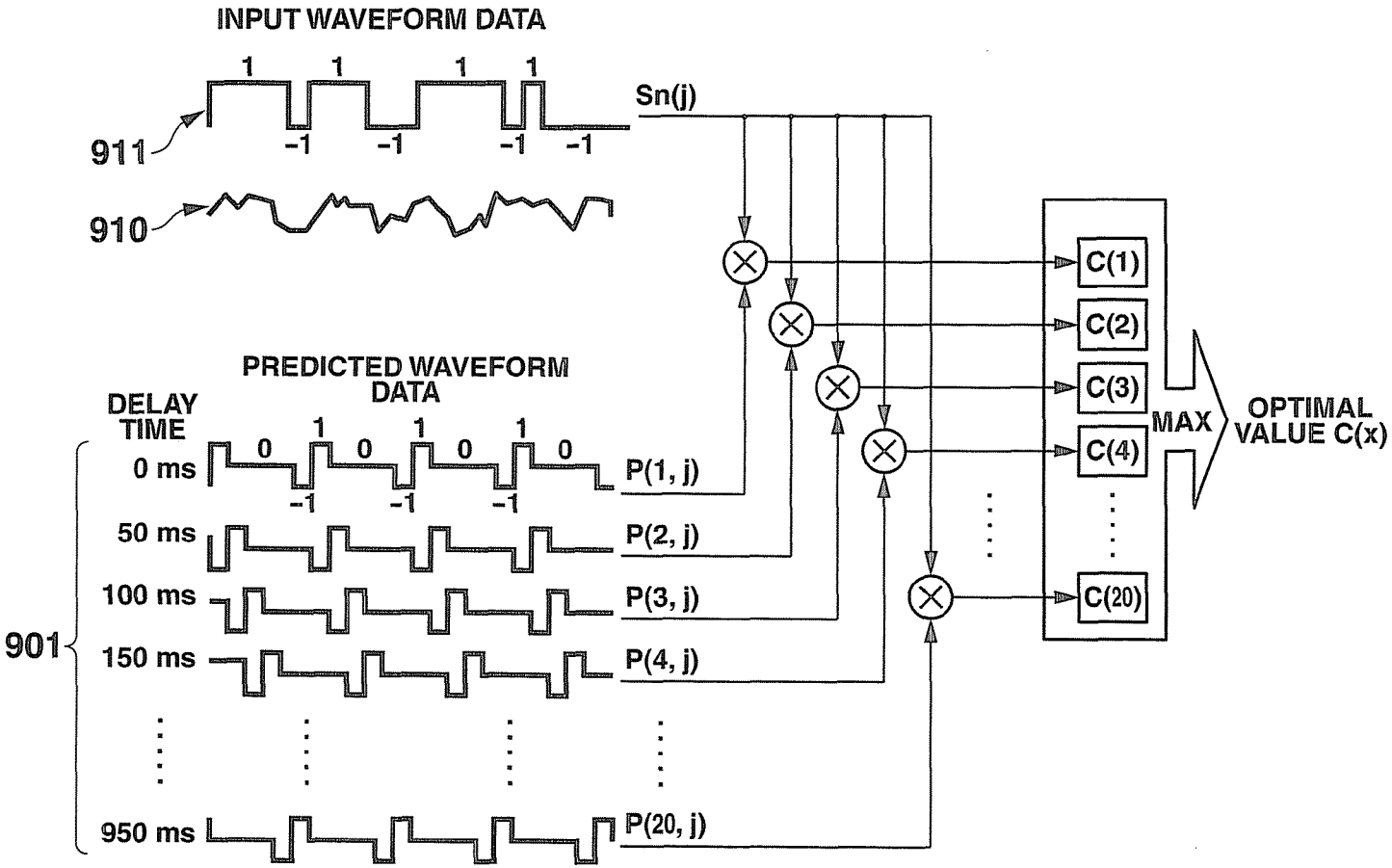
FIG. 11 is a diagram schematically illustrating a process of detecting the second pulse position according to this embodiment.

FIG. 10 is a flowchart illustrating the process of detecting the second pulse position (second synchronization) according to this embodiment in more detail. FIG. 11 is a diagram schematically illustrating the process of detecting the second pulse position according to this embodiment. As shown in FIG. 10, the CPU 11 controls the predicted waveform data generator 23 to generate 20 predicted waveform data items P(1, j) to P(20, j) each with 4 unit time lengths (4 seconds) in which the initial change positions where the data change from a low level to a high level are shifted by 50 ms, as described above (Step S801: reference numeral 901 in FIG. 11). The value of the predicted waveform data is any one of the first value, the second value, and the third value, as described with reference to FIG. 9.

Then, the CPU 11 controls the waveform extractor 24 to extract data (see reference numeral 910 in FIG. 11) with 4 unit time lengths (4 seconds) from data stored in the received waveform data buffer 22 and generate input waveform data Sn(j) (Step S802: reference numeral 911 in FIG. 11). In this embodiment, since data of 20 samples per second is acquired, Sn(j) is data including 80 samples. In order to improve the processing speed or reduce the size of the received waveform data buffer 22, the waveform extractor 24 may extract sample data in the order of Sn(1), Sn(2), . . . , and so on from the received waveform data buffer 22 before all data with 4 unit time lengths are stored in the received waveform data buffer 22.

In this embodiment, the input waveform data generator 21 binarizes the analog signal (see reference numeral 910 in FIG. 11) output from the receiver 16 using a predetermined level as a threshold value. During binarization, in the case of the low level, the first value −1 is given as a data value, and in the case of the high level, the second value 1 is given as a data value. Therefore, digital data including the first value and the second value is stored in the received waveform data buffer 22. The input waveform data Sn(j) extracted by the waveform extractor 24 also has the first value or the second value.

Then, the CPU 11 controls the correlation value calculator 25 to initialize a parameter p which specifies the predicted waveform data with 1 (Step S803) and to calculate a correlation value (covariance value) C(p) between the input waveform data Sn(j) and the predicted waveform data P(p, j) (Step S804).

In this embodiment, the correlation value calculator 25 calculates the covariance value C(p) using the data value Sn(j) of the input waveform data, the average value Sm thereof, the data value P(p, j) of the predicted waveform data, and the average value Pm thereof according to the following expression:

$$C(p)=(1/N)\times\Sigma((Sn(j)-Sm)\times(P(p,j)-Pm))$$

where $Sm=(1/N)\times\Sigma(Sn(j))$ and $$Pm=(1/N)\times\Sigma(P(p,j))$$

In FIGS. 11, C(1), C(2), . . . , and C(20) are obtained by calculating the covariance values between Sn(j) and P(1, j), P(2, j), . . . , and P(20, j).

In addition, E is for j=1 to N. As described above, when the waveform extractor 24 extracts sample data in the order of Sn(1), Sn(2), . . . , and so on, not all of Sn(j) (j=1 to N) are acquired in Step 703. Therefore, in Step 703, the average value $Sm=(1/N)\times\Sigma(Sn(j))$ is not obtained.

However, C(p) is modified as follows:

$$C(p)=(1/N)\times\Sigma(Sn(j)\times(p,j))-Sm\times Pm.$$

Therefore, whenever the waveform extractor 24 acquires the sample data Sn(j), the correlation value calculator 25 calculates Sn(j)×P(p, j) and repeats a process of accumulating the calculated value, which is the multiplication result, to the addition result. When the last sample data Sn(N) is acquired, the correlation value calculator 25 may calculate the average value Sm and subtract Sm×Pm from the accumulation result.

In this embodiment, when Sn(j) is the first value −1 and P(p, j) is the first value −1, Sn(j)×P(p, j) is 1. Similarly, when Sn(j) is the second value 1 and P(p, j) is the second value 1, Sn(j)×P(p, j) is 1. That is, when P(p, j) has the first value or the second value and Sn(j) and P(p, j) have the same value, a predetermined value (in this embodiment, 1) indicating a positive correlation is obtained.

When Sn(j) is the first value −1 and P(p, j) is the second value 1, Sn(j)×P(p, j) is −1. Similarly, when Sn(j) is the second value 1 and P(p, j) is the first value −1, Sn(j)×P(p, j) is −1. That is, when P(p, j) has the first value or the second value and Sn(j) and P(p, j) do not have the same value, a predetermined negative value (in this embodiment, −1) indicating a negative correlation is obtained.

When P(p, j) is the third value 0, Sn(j)×P(p, j) is 0 which has no effect on the calculation of the covariance value, regardless of the value of Sn(j).

Figure 12:
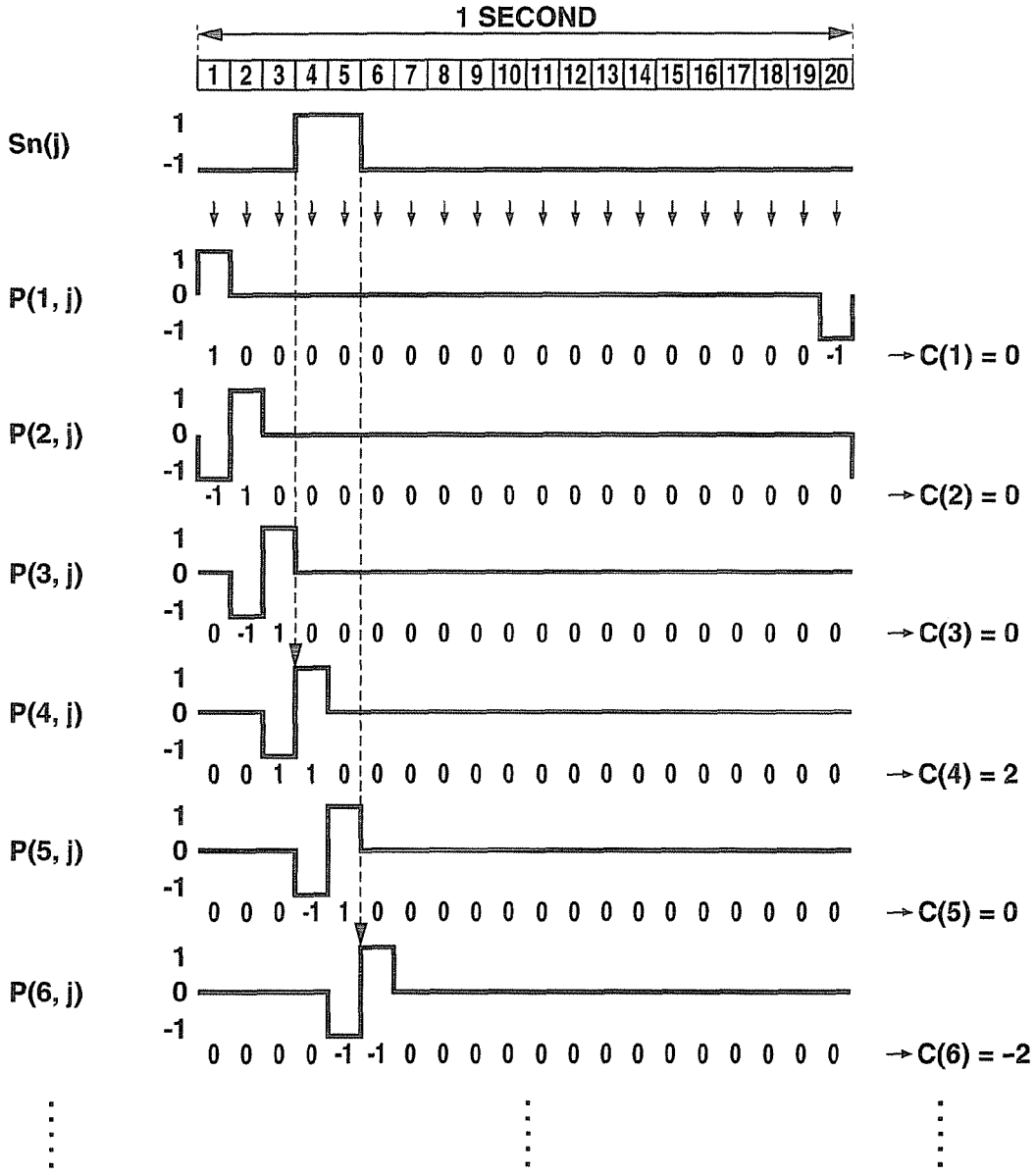
FIG. 12 is a diagram illustrating an example of the calculation of a covariance value according to this embodiment.

FIG. 12 is a diagram illustrating an example of the calculation of the covariance value according to this embodiment. FIG. 12 shows the input waveform data and the predicted waveform data corresponding to the initial one second (j=1 to 20). C(1) to C(6) shown on the right side of FIG. 12 do not indicate the covariance values, but indicate the accumulated value of Sn(j)×P(p, j). The input waveform data Sn(j) is at a high level indicating the second value 1 when j is 4 and 5. The input waveform data Sn(j) is at a low level indicating the first value −1 in the other cases.

In the predicted waveform data P(1, j) to P(3, j), C(1) to C(3) are 0. However, in the predicted waveform data P(4, j) in which the rising edge position of the waveform is aligned with the rising edge position of the waveform of the input waveform data Sn(j), C(4) is 2. In the predicted waveform data P(6, j) in which the rising edge position of the waveform is aligned with the falling edge position of the waveform of the input waveform data Sn(j), C(6) is −2.

As such, in this embodiment, when the rising edge position of the input waveform data is aligned with the rising edge position of the predicted waveform, a large covariance value indicating a strong correlation appears. When the falling edge position of the input waveform data is aligned with the rising edge position of the predicted waveform, that is, when the phases of the waveforms are opposite to each other, a negative covariance value indicating a negative correlation appears. A value of 0 that has no effect on the calculation result appears when the rising edge position of the predicted waveform is aligned with other positions of the input waveform data.

When the parameter p is smaller than 20 (No in Step S805), the parameter p is incremented (Step S806), and the process returns to Step S804. When covariance values C(1) to C(20) are acquired for all of the parameters p, the determination result in Step S805 is "Yes". In this case, the correlation value comparator 26 compares the covariance values C(1) to C(20) to find an optimal value (in this case, the maximum value)

C(x) (Step S807). The CPU 11 receives the optimal value C(x) and determines whether the optimal value is valid (Step S808).

The maximum value C(x) of the obtained covariance values C(p) is a predicted waveform with the highest correlation. However, in the covariance value obtained from a sample with insufficient moduli, the maximum value is likely to appear due to an unexpected factor caused by noise. In order to exclude this case, for example, in Step S808, the following criteria are set to prevent an error in detection:

(1) The number of input waveform data used to calculate the covariance is equal to or more than a predetermined value;

(2) The value x indicating C(x) appears plural times, the values x appearing plural times are equal to each other, and the frequency of the value of x is higher than that of other values (x is a mode value);

(3) The values x that continuously appear a predetermined number of times or more are equal to each other (the continuity of a mode value);

(4) The variance of C(p) is equal to or less than a predetermined value; and (5) Kurtosis or the degree of distortion, which is the amount of statistics of C(p), or an evaluation function equivalent thereto is calculated and it is determined whether the calculation result reaches a predetermined value.

When the criteria (1) to (3) are applied, a set of Steps 802 to 807 in FIG. 10 is performed plural times.

A method of determining validity is not limited to the above-mentioned method. The average value of the covariance values or the standard deviation may be used and the covariance value smaller than the average value may be determined to be insignificant even though the covariance value is the maximum value. In addition, the level of significance (for example, 5 percent) that is generally used in statistics may be used.

If it is determined that the optimal value C(x) is valid (Yes in Step S808), the CPU 11 determines the changing point of the signal level of the predicted waveform data indicated by the optimal value C(x), that is, the position where the first value indicating a low level changes to the second value indicating a high level to be the second pulse position (Step S809). The CPU 11 stores the information of the second pulse position in the RAM 15. The second pulse position is used in, for example, the process of detecting the minute head position, which will be described below.

Referring to FIG. 4 again, when the detection of the second pulse position, that is, the second synchronization ends (Step S401), the minute head position is detected (Step S402). The detection of the minute head position is also referred to as minute synchronization. In Step S401, the second pulse position (the head position of the second) has already been set. In JJY, in a one-minute frame, a code indicating the position marker P0 is arranged at the end, and a code indicating the marker M is arranged at the head. Therefore, in the minute synchronization, the CPU 11 and the like determine whether the code that indicates the position marker P0 which is arranged at the end of the frame and the code that indicates the marker M arranged at the head of the frame are continuous.

Figure 13:
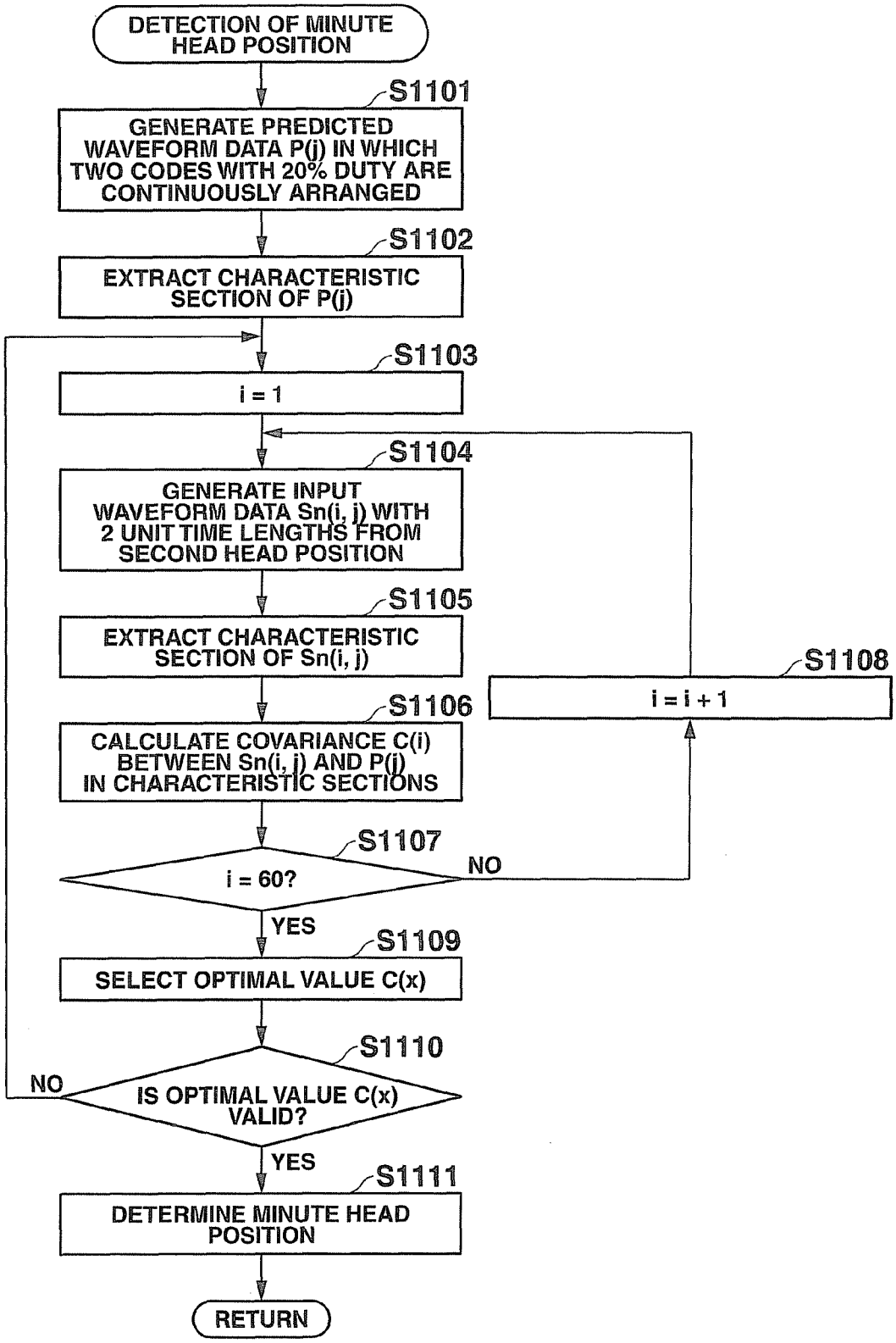
FIG. 13 is a flowchart illustrating the detection of a minute head position (minute synchronization) according to this embodiment in more detail.
Figure 14:
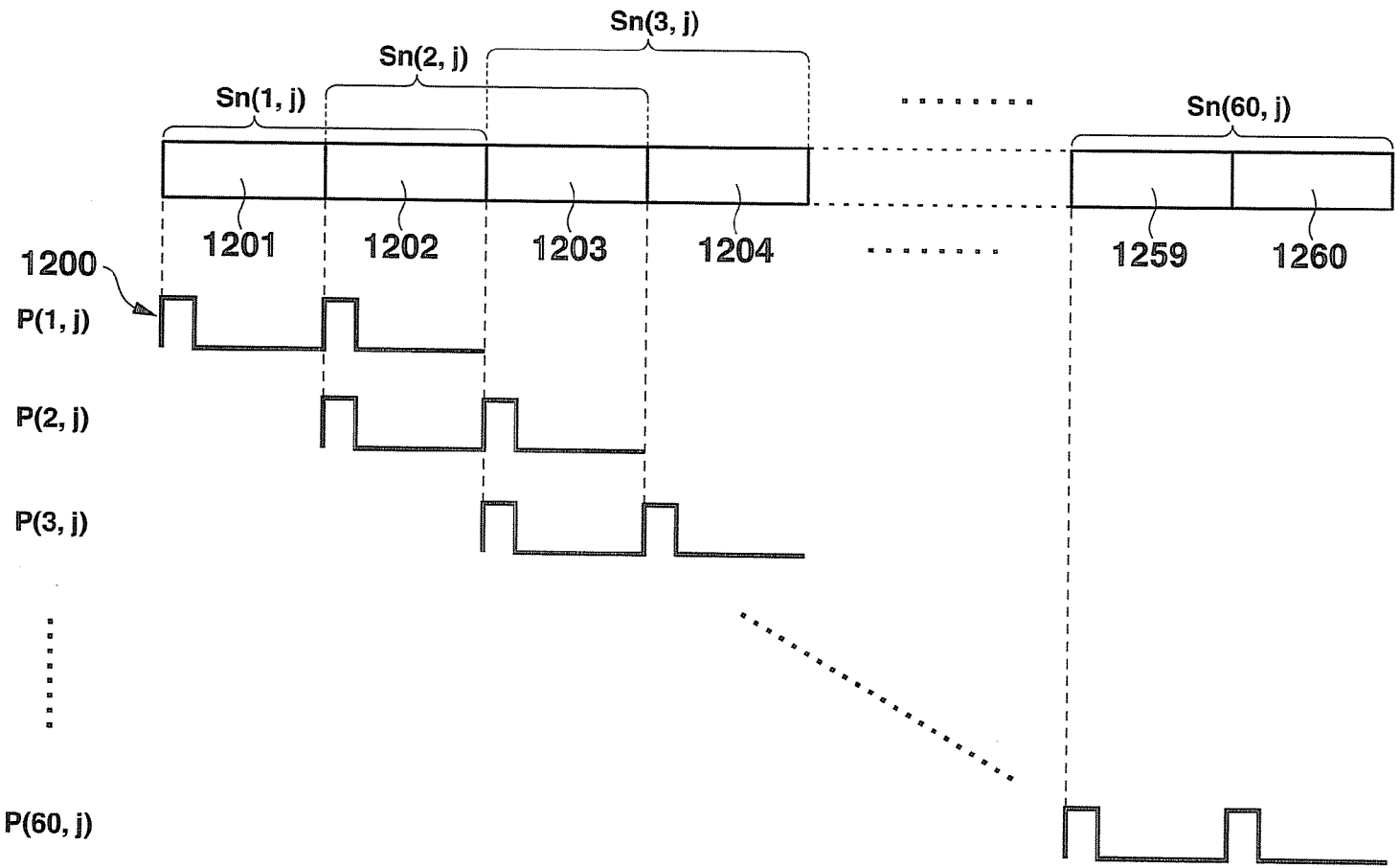
FIG. 14 is a diagram illustrating input waveform data and predicted waveform data in the detection of the minute head position according to this embodiment.

Next, the detection of the minute head position will be described in detail. The detection of the minute head position is also referred to as minute synchronization. FIG. 13 is a flowchart illustrating the detection of the minute head position (minute synchronization) according to this embodiment in more detail. FIG. 14 is a diagram illustrating the input waveform data and the predicted waveform data in the detection of the minute head position according to this embodiment. The second pulse position (the head position of the second) has already been set by the second synchronization. As shown in FIGS. 5A and 5B, the codes P with a 20% duty are continuously arranged positions before and after the minute head position (that is, at $60^{th}$ second position and $1^{st}$ second position). In the minute synchronization, predicted waveform data with 2 unit time lengths is generated in which the codes P with a 20% duty are continuously arranged. 60 input waveform data items each having 2 unit time lengths (2 seconds) starting at the second pulse position (the head position of a second) are generated. It is possible to obtain 60 correlation values (covariance values) C(1) to C(60) by calculating the correlation value between the predicted waveform data and each of the 60 input waveform data items.

As shown in FIG. 13, the predicted waveform data generator 23 generates predicted waveform data P(j) with 2 unit time lengths in which two codes P are arranged, under the control of the CPU 11 (Step S1101). As shown in FIG. 14, the predicted waveform data (see reference numeral 1200) has two waveforms, which are the same and are at a high level during a first period of 200 ms (20%) and at a low level during the remaining period in the unit time length (one second).

Figure 15A:
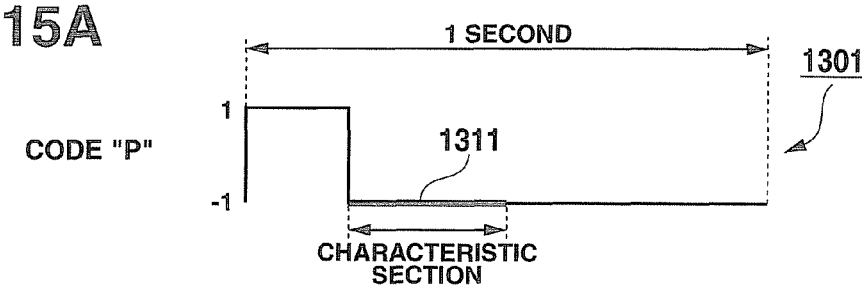
FIGS. 15A, 15B, and 15C are diagrams illustrating the characteristic section of each code in the JJY standard.
Figure 15B:
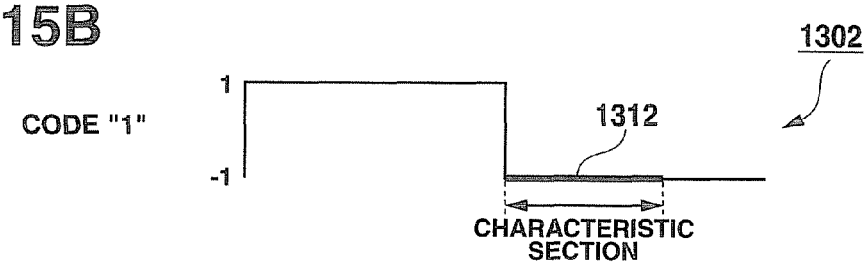
Figure 15C:
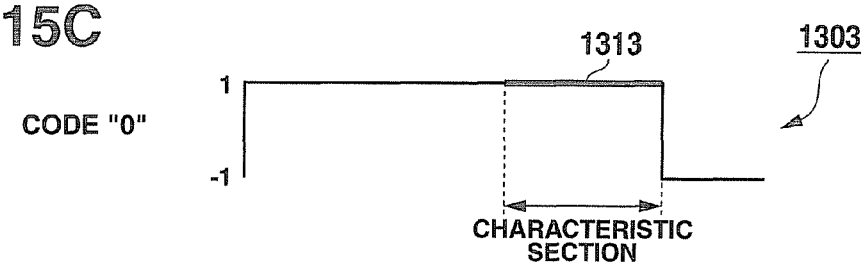

The characteristic section extractor 28 extracts a data value (characteristic value) in the characteristic section of the predicted waveform data P(j) (Step S1102). FIGS. 15A, 15B, and 15C are diagrams illustrating the characteristic section of each code in JJY. The code P (see reference numeral 1301) shown in FIG. 15A, the code 1 (see reference numeral 1302) shown in FIG. 15B, and the code 0 (see reference numeral 1303) shown in FIG. 15C have sections in which they have eigenvalues different from those of other codes. For example, the code P is at a low level (data value −1) in the section from 200 ms to 500 ms and has an eigenvalue −1 different from those of other codes in the section (see reference numeral 1311).

Therefore, in this embodiment, with respect to the code P, the section from 200 ms to 500 ms is a characteristic section. In the predicted waveform data P(j) shown in FIG. 14, when the number of samples with a unit time length is 20, j is 1 to 40. In this case, the characteristic section extractor 28 extracts only data values in the section from 200 ms to 500 ms and the section from 1200 ms to 1500 ms, that is, extracts P(5) to P(10) and P(25) to P(30) as the characteristic values.

In the code decoding process, the characteristic value in the characteristic section of the predicted waveform data is also used, which will be described below. In the code decoding process, the code 0 or the code 1 may be determined. That is, since the minute synchronization has been completed, it is not necessary to determine the code P.

As shown in FIG. 15B, the code 1 is at a low level (data value −1) and has an eigenvalue −1 different from that of the code 0 in the section (see reference numeral 1312) from 500 ms to 800 ms. As shown in FIG. 15C, the code 0 is at a high level (data value 1) and has an eigenvalue 1 different from that of the code 1 in the section (see reference numeral 1313) from 500 ms to 800 ms. Therefore, with respect to each of the codes 1 and 0, the section from 500 ms to 800 ms is the characteristic section. The characteristic value of the code 1 in the characteristic section 1312 is −1 and the characteristic value of the code 0 in the characteristic section 1313 is 1.

Then, a parameter i which specifies the second head position is initialized and the waveform extractor 24 generates input waveform data Sn(i, j) with 2 unit time lengths (2 seconds) from the second head position, from the received waveform data buffer 22 under the control of the CPU 11 (Step S1104). The characteristic section extractor 27 extracts a data value in the characteristic section of Sn(i, j) so as to correspond to the characteristic section of the predicted waveform data based on information from the characteristic section extractor 28 (Step S1105). When i is 1, the characteristic section extractor 27 extracts Sn(1, 5) to Sn(1, 10) and Sn(1, 25) to Sn(1, 30) as the data values in the characteristic sections. In general, Sn(i, 5) to S(i, 10) and Sn(i, 25) to S(i, 30) are extracted as data belonging to the characteristic sections.

Then, the correlation value calculator 25 calculates a correlation value (covariance value) C(i) between the input waveform data Sn(i, j) in the characteristic section and the predicted waveform data P(j) in the characteristic section (Step S1106). Since the covariance value is calculated by the same method as that in the second synchronization process, only a balance with the characteristic section will be described. In this embodiment, in the input waveform data, Sn(i, 5) to S(i, 10) and Sn(i, 25) to S(i, 30) are extracted as the data values in the characteristic sections. In the predicted waveform data, P(5) to P(10) and P(25) to P(30) are extracted.

Therefore, when the covariance value C(i) is calculated, in the total sum $\Sigma Sn(i, j) \times P(j)$ of the products between the data values of the input waveform data and the data values of the predicted waveform data, j is 5 to 10 and 25 to 30. As described with reference to FIG. 15A, the data value (characteristic value) of the code P in the characteristic section 1311 is −1. Therefore, the predicted waveform data P(j) (j=5 to 10 and 25 to 30) in the predicted section is −1. When the total sum of the products is calculated, Sn(i, j) (j=5 to 10 and 25 to 30) may be calculated and multiplied by a characteristic value −1.

Then, the CPU 11 determines whether the parameter i is 60 (Step S1107). When the determination result in Step S1107 is "No," the parameter i incremented (Step S1108). Then, in Step S1104, the waveform extractor 24 acquires the input waveform data Sn(i, j) with 2 unit time lengths (2 seconds) from the next second head position (that is, the position that is 20-sample away from the previous second head position of the input waveform data) under the control of the CPU 11. Then, the covariance value between the newly acquired input waveform data Sn(i, j) and the predicted waveform data P(j) is calculated.

As shown in FIG. 14, the input waveform data Sn(1, j) includes data items 1201 and 1202 with 2 unit time lengths and starts from the second head position. The next input waveform data Sn(2, j) includes data items 1202 and 1203 with 2 unit time lengths and starts from the next second head position. As such, Sn(n−1, j) and Sn(n, j) are data having a positional deviation of a unit time length (one second) between the second head positions. The last input waveform data Sn(60, j) includes data items 1259 and 1260 with 2 unit time lengths and is 59-second away from the first input waveform data Sn(1, j).

The data values in the characteristic sections of the input waveform data S(1, j), S(2, j), S(3, j), and S(60, j) and the data values in the characteristic sections of the predicted waveform data are used to calculate the covariance values. In FIG. 14, for convenience of illustration, the predicted waveform data used to calculate the covariance values together with Sn(1, j), Sn(2, j), Sn(3, j), . . . , and Sn(60, j) are denoted by P(1, j), P(2, j), P(3, j), . . . , and P(60, j). However, actually, the predicted waveform data P(1, j), P(2, j), P(3, j), . . . , and P(60, j) have the same value P(j).

When all of the correlation values (covariance values) C(1) to C(60) are acquired, the correlation value comparator 26 compares the covariance values C(1) to C(60) to find an optimal value (in this case, the maximum value) C(x) (Step S1109). The CPU 11 receives the optimal value C(x) and determines whether the optimal value is valid (Step S1110). The process of determining whether the optimal value is valid is performed by the same method as that in the second synchronization process (Step S808 in FIG. 10). If the determination result in Step S1110 is "No", the process returns to Step S1103 and the waveform extractor 24 acquires input waveform data which is different from the data used in the previous process and is stored in the received waveform data buffer 22, under the control of the CPU 11.

If the determination result in Step S1110 is "Yes", the CPU 11 determines the head position of the second code P in the input waveform data indicated by the optimal value C(x), that is, the position where the second low level changes to a high level, to be the head position of the minute (Step S1111). The CPU 11 stores the information of the head position of the minute in the RAM 15.

Figure 16:
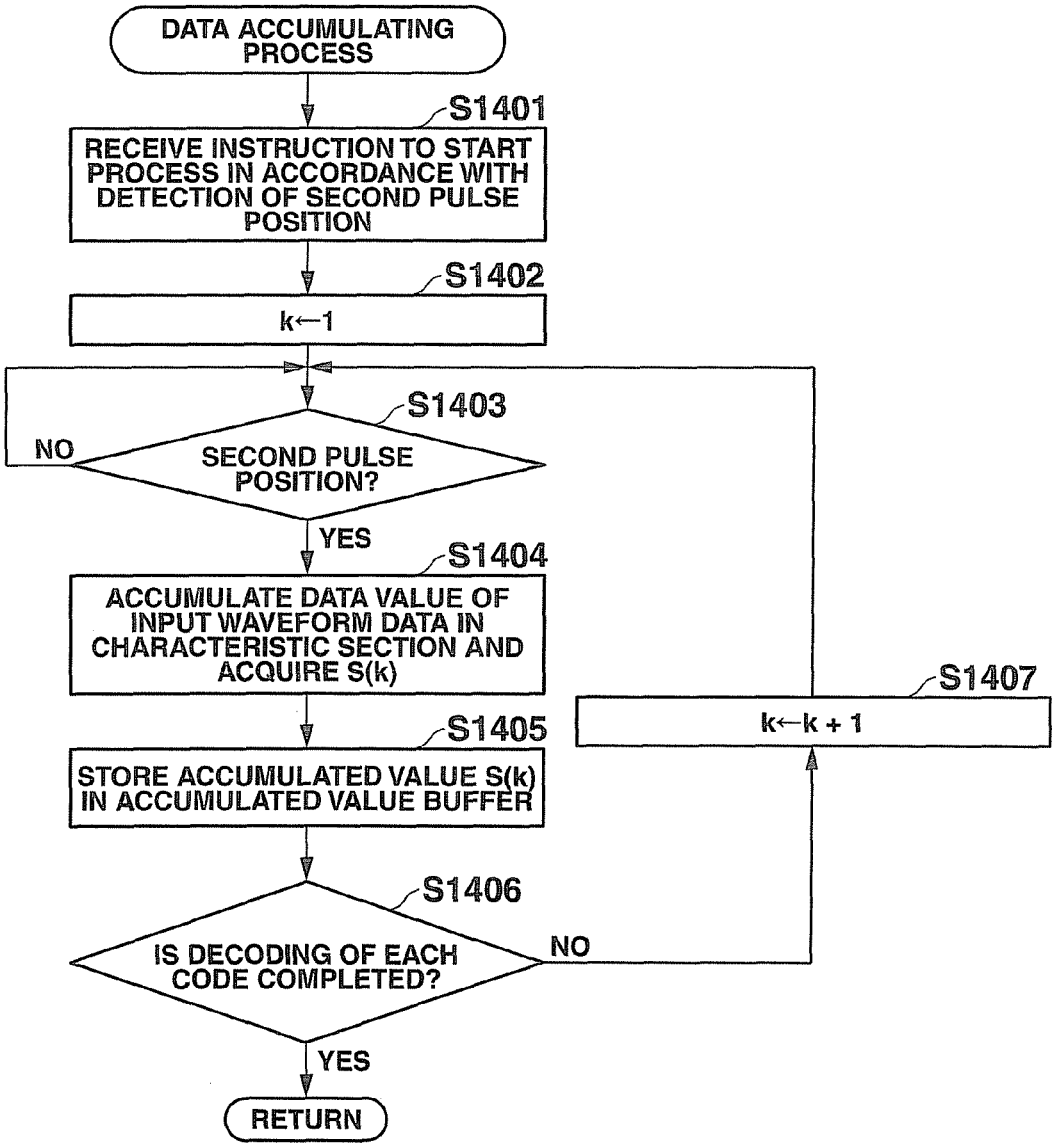
FIG. 16 is a flowchart illustrating an example of a process of accumulating data values according to this embodiment.

In this embodiment, when the detection of the second pulse position ends and the detection of the minute head position starts, the data value in the characteristic section of the input waveform data is accumulated every second so as to be synchronized with the second head position. FIG. 16 is a flowchart illustrating an example of the process of accumulating the data value according to this embodiment. When the detection of the second pulse position ends, the CPU 11 gives an instruction to accumulate data to the signal comparator 18. When the instruction is received (Step S1401), the data value accumulator 29 of the signal comparator 18 initializes the parameter k, which specifies an accumulated value S to 1 every second (Step S1402).

At the detected second pulse position, the CPU 11 outputs the signal to the data value accumulator 29. At the second pulse position, that is, when the input waveform data corresponds to the head of the second (Step S1403), the data value accumulator 29 obtains the data value in the characteristic section of the input waveform data and sequentially accumulates the data value to acquire an accumulated value S(k) (Step S1404). The characteristic section means a section from 500 ms to 800 ms from the head position of the second in the input waveform data for every second. That is, when the number of samples with a unit time length (one second) is 20 and the data length of the input waveform data Sn(i, j) (i is a parameter for specifying the input waveform data and j is 1 to 20) is equal to the unit time length, Sn(i, 11) to Sn(i, 16) are extracted as data in the characteristic sections and the accumulated value of Sn(i, 11) to Sn(i, 16) is obtained as S(k).

The data value accumulator 29 stores the obtained accumulated value S(k) in the accumulated value buffer 30 (Step S1405). When a signal indicating the end of the code decoding process is received from the CPU 11 (Yes in Step S1406), the process ends. On the other hand, when the determination result in Step S1406 is "No," the data value accumulator 29 increases the parameter k (Step S1407) and the process returns to Step S1403.

Next, a process of decoding a code forming a time code will be described. When the head position of the minute is set, the positions of various kinds of codes, such as year, month, day, hour, and minute codes, in the time code are set. In this embodiment, as described above, after the second pulse position is set, the data value S(k) in the characteristic section is accumulated every second with reference to the input waveform data every second and the accumulated value is stored in the accumulated value buffer 30.

In this embodiment, the correlation values (covariance values) between a set of the predicted values in the characteristic sections of the predicted waveform data obtained by predicting codes and a set of the accumulated values in the accumulated value buffer may be calculated and it is possible to settle a value indicated by the codes, such as the year, month, day, hour, and minute codes, included in the time code from a code value corresponding to the optimal predicted waveform data among the covariance values. In addition, since the characteristic value of the characteristic section is a coefficient multiplied by the accumulated value, it is also referred to as a multiplier.

First, the decoding of one's place M1 of the minute will be described. The one's place of the minute has any one of the values 0 to 9. In the time code, the one's place is represented by a 4-bit BCD code. That is, the input waveform data with 4 unit time lengths from the head position of a code indicating the one's place of the minute indicates any one of "0000" to "1001". In this embodiment, the values in the characteristic sections of the predicted waveform data corresponding to each bit of BCD="0000" to "1001" are acquired as the multipliers, and the covariance values between the four multipliers and the corresponding accumulated values are calculated.

Figure 17:
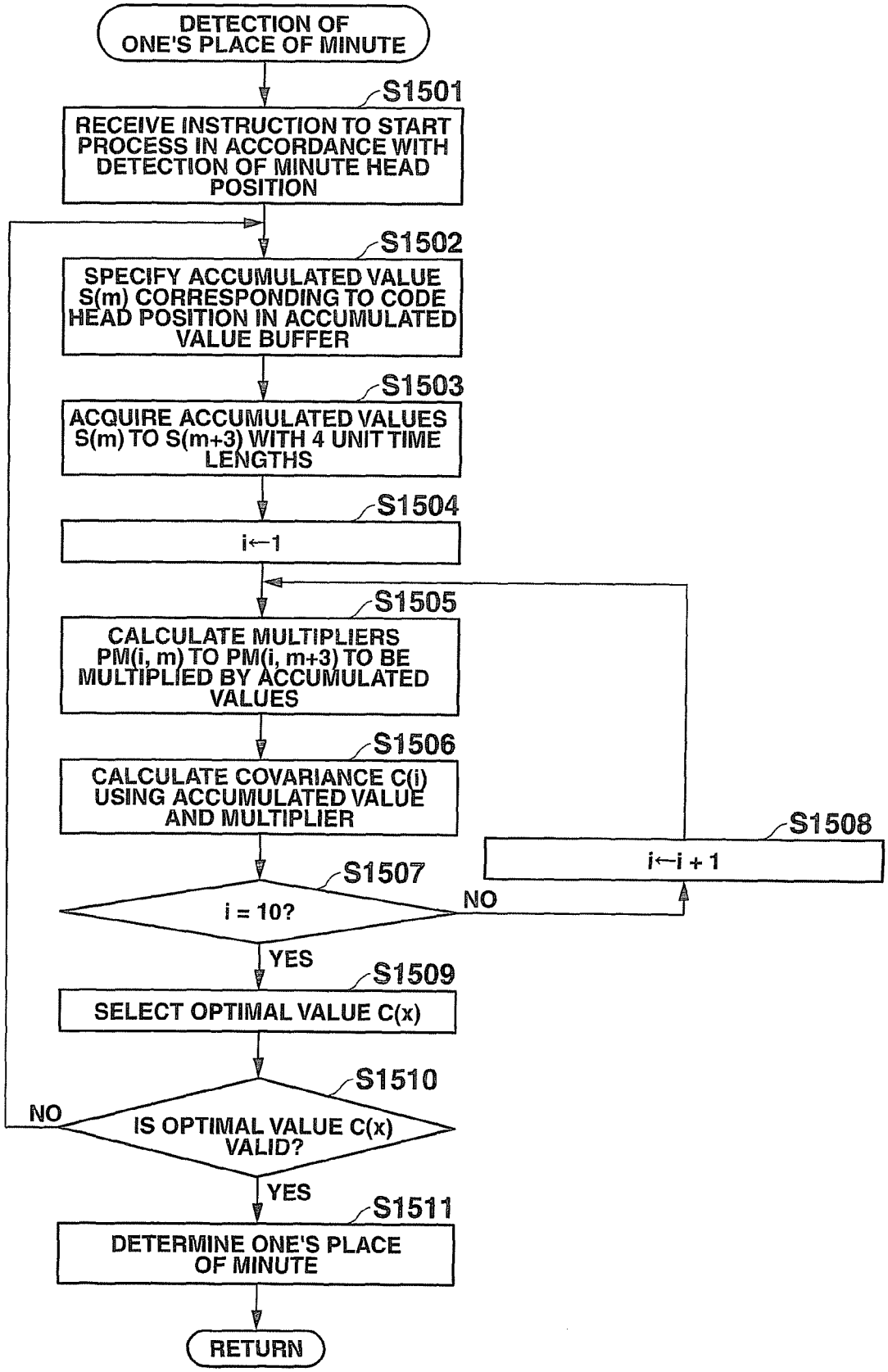
FIG. 17 is a flowchart illustrating a process of decoding one's place of the minute according to this embodiment in more detail.
Figure 18:
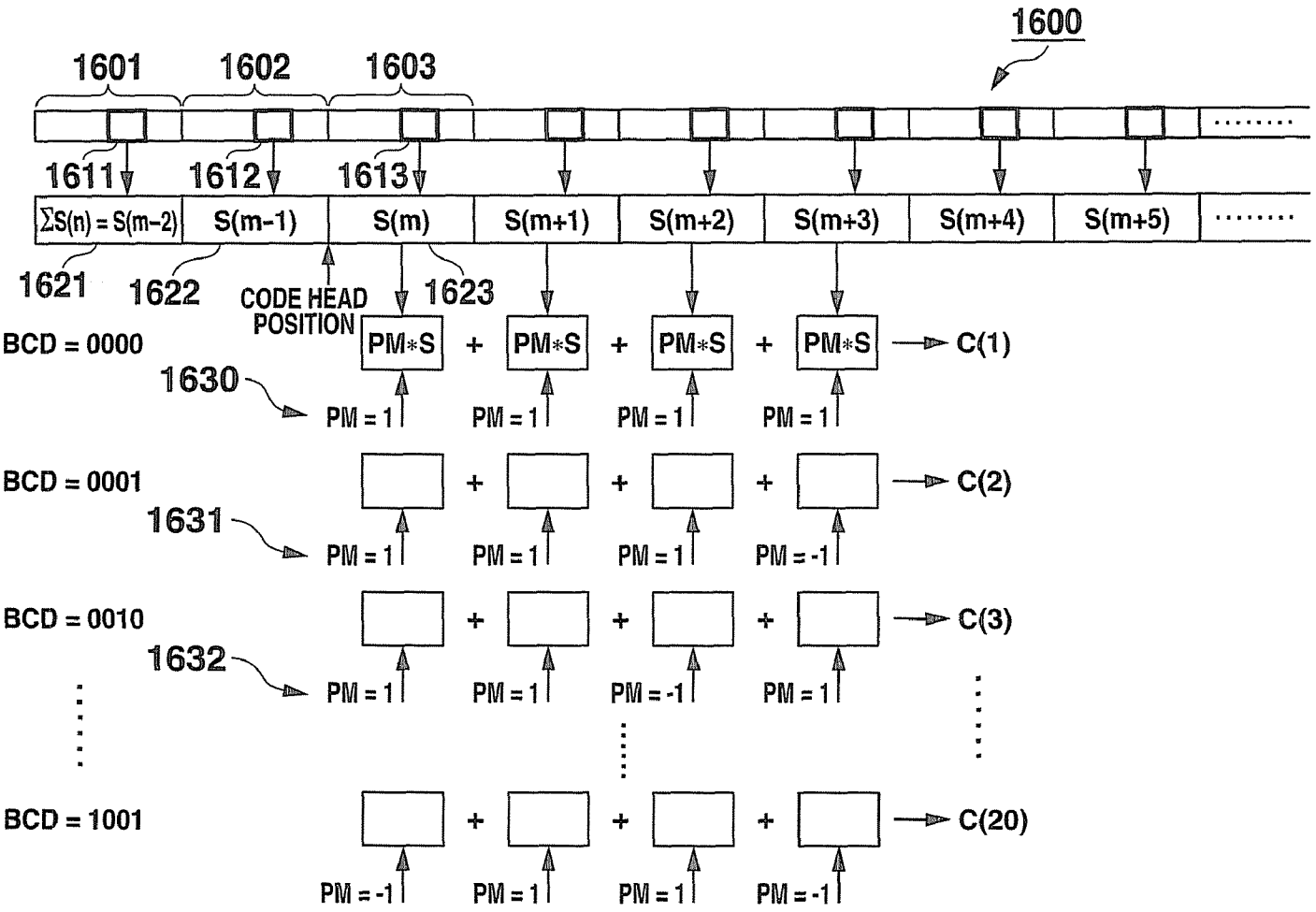
FIG. 18 is a diagram schematically illustrating a decoding process according to this embodiment.

FIG. 17 is a flowchart illustrating the process of decoding one's place of the minute according to this embodiment in more detail. FIG. 18 is a diagram schematically illustrating the decoding process according to this embodiment.

When the detection of the minute head position ends, the CPU 11 gives an instruction to start the decoding of a code to the signal comparator 18. When the instruction is received (Step S1501), the correlation value calculator 35 specifies the accumulated value S(m) corresponding to the head position of the code indicating one's place of the minute in the accumulated value buffer 30 with reference to the accumulated value buffer 30 (Step S1502). When the process shown in FIG. 17 starts, the minute head position is settled. Therefore, first, the correlation value calculator 25 specifies an accumulated value corresponding to the minute head position among the accumulated values stored in the accumulated value buffer 30 according to the process shown in FIG. 16. Then, the correlation value calculator 25 specifies the accumulated value S(m) corresponding to the head position of the code indicating one's place of the minute, which is a predetermined distance away from the minute head position, according to the time code standard.

Then, the correlation value calculator 25 acquires the accumulated values S(m) to S(m+3) corresponding to 4 unit time lengths as the head of the accumulated value S(m) (Step S1503). Then, the correlation value calculator 25 initializes the parameter i for specifying the BCD code to 1 (Step S1504).

The correlation value calculator 25 acquires multipliers PM(i, m) to PM(i, m+3) to be multiplied by the accumulated values S(m) to S(m+3) from the characteristic section extractor 28 (Step S1505). As described with reference to FIGS. 15B and 15C, in the codes 1 and 0, the section from 500 ms to 800 ms is the characteristic section. The data value (characteristic value) of the code 1 in the characteristic section 1312 is a constant value −1 and the data value (characteristic value) of the code 0 in the characteristic section 1313 is a constant value 1. Therefore, each of the multipliers PM(i, m) to P(i, m+3) is 1 or −1.

For example, when i is 1 (BCD="0000"), each of PM(1, m) to P(1, m+3) is 1. When i is 2 (BCD="0001"), PM(2, m) to P(2, m+2) are 1 and P(2, m+3) is −1. When i is 3 (BCD="0010"), P(3, m), P(3, m+1), and P(3, m+3) are 1 and P(3, m+2) is −1 (see reference numerals 1630 to 1632 in FIG. 18).

Then, the correlation value calculator 25 multiplies the accumulated values S(m) to S(m+3) by the corresponding multipliers PM(i, m) to P(i, m+3), adds the calculated values to obtain the total sum Σ(S(q)×P(i, q)) (q=m to m+3), and calculates the covariance value C(i) based on the total sum (Step S1506).

As described above, the covariance value C(p) between the input waveform data Sn(j) and the predicted waveform data P(p, j) is calculated as follows:

$$C(p)=(1/N)\times\Sigma(Sn(j)\times P(p,j))-Sm\times Pm.$$

Sn(j)×P(p, j) is the product between the data values in the characteristic sections of the predicted waveform data.

For ease of understanding, the product Sm×Pm between the average values is regarded as 0. When this is divided in the unit of one second, the covariance value C(p) is rearranged as follows:

$$C(p)=(1/N)(\Sigma Sn\times P+\Sigma Sn\times P+\Sigma Sn\times P\ldots)$$

where Sn and P are data with a unit time length of Sn(j) and S(p, j)

As described above, the value of the characteristic section of the predicted waveform data with a unit time length is a constant value 1 or −1. Therefore, the covariance value C(p) is rearranged as follows:

$$C(p)=(1/N)(P\times\Sigma Sn+P\times\Sigma Sn+P\times\Sigma Sn\ldots)$$

That is, it is possible to arrange P, which is a constant value, outside sigma (Σ). In the above-mentioned expression, ΣSn is the characteristic section in the unit time length and corresponds to the accumulated value S stored in the accumulate buffer. In addition, P corresponds to a multiplier PM. As such, in this embodiment, when the accumulated value S of the data values with a unit time length is acquired in advance, it is possible to obtain the total sum Σ(Sn(j)×P(p, j)) of the calculated values (multiplied values) of the data values in the calculation of the covariance values by multiplying the accumulated value by 1 or −1 and adding the calculated values.

As described above, it is possible to calculate the covariance value C(p), that is, the covariance value C(i) based on the total sum of the values obtained by multiplying the accumulated values which are accumulated by the data value accumulator 29 and then stored in the accumulated value buffer 30 by a multiplier 1 or −1. For convenience of explanation, the parameter p and the parameter i are used. However, the parameters have the same meaning.

When the parameter i is smaller than 10 (No in Step S1507), the parameter i increases (Step S1508) and the process returns to Step S1505. If the determination result in Step S1507 is "Yes", the correlation value comparator 26 compares the obtained covariance values C(1) to C(10) to find the optimal value (in this case, the maximum value) C(x) (Step S1509). The CPU 11 receives the optimal value C(x) and determines whether the optimal value is valid (Step S1510). If it is determined that the optimal value C(x) is valid (Yes in Step S1510), the CPU 11 determines the value of BCD indicating the optimal value C(x) to be one's place of the minute (Step S1511). The CPU 11 stores the one's place of the minute in the RAM 15. If the determination result in Step S1510 is "No", the process returns to Step S1502. After the second or later processes, in Step S1502, the accumulated value S(m) corresponding to the head position of another code may be found with reference to the accumulated value stored in the accumulated value buffer 30 and S(m) to S(m+3) may be acquired. When the covariance value C(i) is calculated, a new covariance value may be calculated based on the newly found accumulated value. Alternatively, the covariance value obtained by the previous process may be added to the new covariance value and the final covariance value may be obtained based on the added value.

Next, the process of calculating one's place of the minute will be described again with reference to FIG. 18. In a group of input waveform data 1600, input waveform data with a unit time length from the second head position is represented by, for example, reference numerals 1601 to 1603. In the data accumulating process shown in FIG. 16, while the minute head position is detected, the data value Sn of each of the characteristic sections (for example, see reference numerals 1611 to 1613) of the input waveform data with a unit time length is accumulated to calculate ΣSn and the calculated accumulated values (for example, see reference numerals 1621 to 1623) are stored in the accumulated value buffer 30.

In the code decoding process, for example, the process of detecting one's place of the minute shown in FIG. 18, values S(m) to S(m+3) from the head position of the code among the accumulated values stored in the accumulated value buffer 30 are read and used for calculation.

Figure 19:
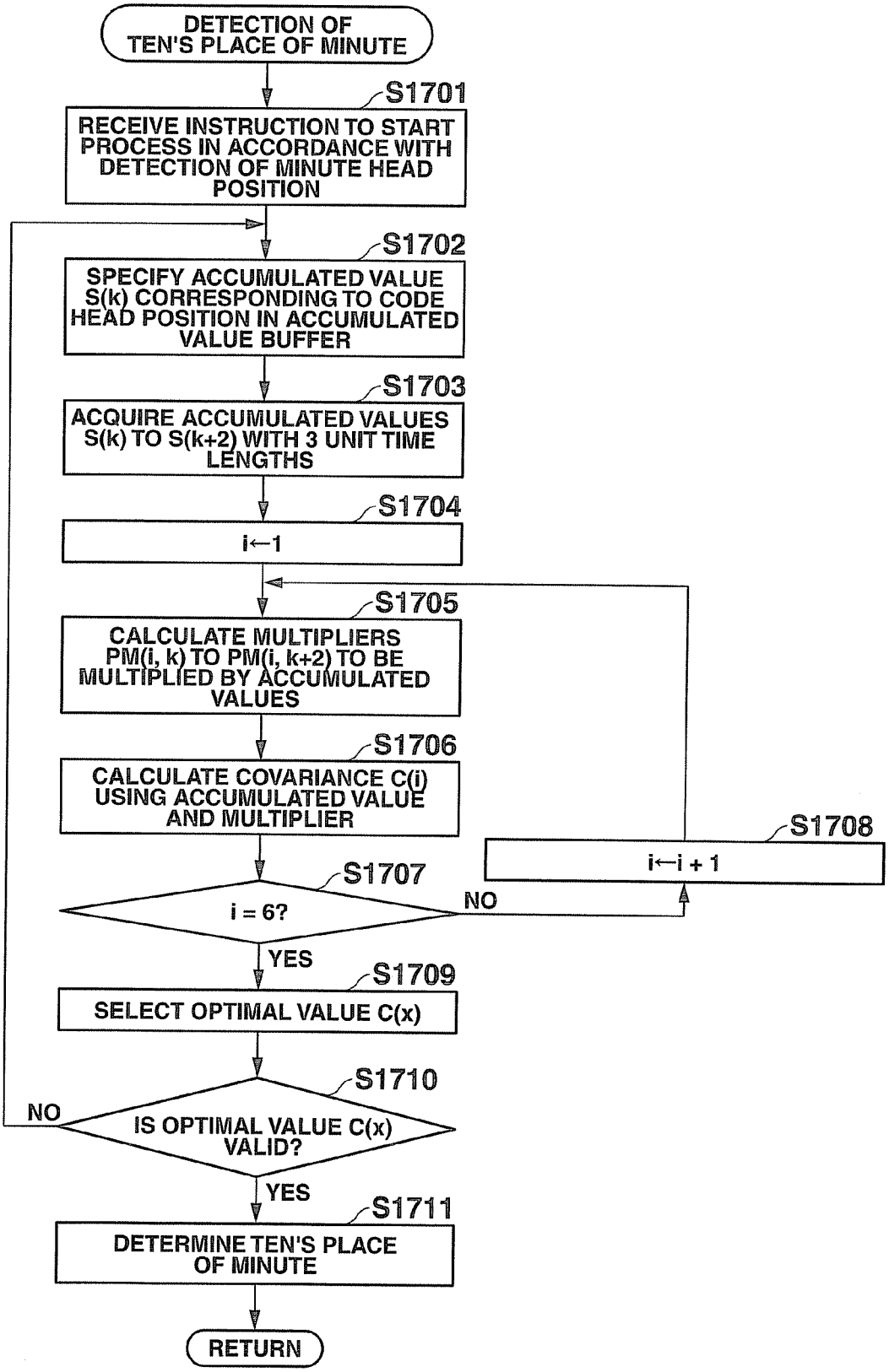
FIG. 19 is a flowchart illustrating a process of decoding ten's place of the minute according to this embodiment in more detail.

The detection of other codes, for example, ten's place of the minute may be performed by the same method as that in the detection of the one's place of the minute. FIG. 19 is a flowchart illustrating the process of detecting ten's place of the minute according to this embodiment in more detail. The process shown in FIG. 19 may be performed in parallel to the process shown in FIG. 17. Step S1701 is the same as Step S1501 shown in FIG. 17.

Then, the correlation value calculator 25 specifies the accumulated value S(k) corresponding to the head position of a code indicating ten's place of the minute in the accumulated value buffer 30 with reference to the accumulated value buffer 30 (Step S1702). The head position of the code indicating ten's place of the minute may be specified by the same method as that specifying the head position of one's place of the minute in Step S1502 shown in FIG. 17. Therefore, it is also possible to specify the accumulated value S(k) corresponding to the head position of the code.

Then, the correlation value calculator 25 acquires the accumulated values S(k) to S(k+2) corresponding to 3 unit time lengths using the accumulated value S(k) as the head (Step S1703). Since the ten's place of the minute is any of 0 (BCD="000") to 5 (BCD="101") and formed of three codes, the accumulated values corresponding to 3 unit time lengths are acquired. Then, the correlation value calculator 25 initializes the parameter i for specifying the BCD code to 1 (Step S1704).

The correlation value calculator 25 calculates multipliers PM(i, k) to PM(i, k+2) to be multiplied by the accumulated values (Step S1705). Similar to Step S1505 shown in FIG. 17, the multipliers correspond to BDD="000" to "101". Then, the correlation value calculator 25 multiplies the accumulated values S(k) to S(k+2) by the corresponding multipliers PM(i, k) to P(i, k+2), adds the calculated values to obtain the total sum, and calculates the covariance value C(i) based on the total sum (Step S1706). The calculation of the covariance value is performed by the same method as that in Step S1506 shown in FIG. 17. When the parameter i is smaller than 6 (No in Step S1707), the parameter i increases (Step S1708) and the process returns to Step S1705. If the determination result in Step S1707 is "Yes", the correlation value comparator 26 compares the obtained covariance values C(1) to C(6) to find the optimal value (in this case, the maximum value) C(x) (Step S1709). The CPU 11 receives the optimal value C(x) and determines whether the optimal value is valid (Step S1710).

If it is determined that the optimal value C(x) is valid (Yes in Step S1710), the CPU 11 determines the value of BCD indicating the optimal value C(x) to be ten's place of the minute (Step S1711). The CPU 11 stores the ten's place of the minute in the RAM 15. If the determination result in Step S1711 is "No", the process returns to Step S1702.

In this way, one's place and ten's place of the minute are obtained. Therefore, it is possible to settle the minute in the hour and minute.

It is possible to specify one's place and ten's place of the hour using substantially the same method as that specifying the ten's place of the minute. When detecting one's place of the hour, the correlation value calculator 25 acquires the accumulated values corresponding to 4 unit time lengths and calculates multipliers corresponding to 4 unit time lengths. Then, the correlation value calculator 25 multiplies the accumulated values by the multipliers to calculate the covariance values. When detecting ten's place of the hour, the correlation value calculator 25 acquires the accumulated values corresponding to 2 unit time lengths and calculates multipliers corresponding to 2 unit time lengths. Then, the correlation value calculator 25 multiplies the accumulated values by the multipliers to calculate the covariance values.

For other codes (an ordinal date from January 1, A.D.), similarly, it is possible to specify each place to obtain the values of the codes. For the day of the week, it is possible to specify any one of 0 to 6 to obtain the value of the day (value indicating the day).

When the decoding of the minute, hour, day (an ordinal date from January 1), and year (A.D.) is completed, the CPU 11 can accurately obtain the current time. Actually, when the decoding of the minute and hour is completed, the current time is generally acquired. The CPU 11 corrects the current time measured by the internal timer 17 with the accurate current time acquired by decoding (Step S404 in FIG. 4). The corrected current time is displayed by the display device 13.

The second synchronization and minute synchronization of the signal in JJY and the decoding of the code have been described above. In other standards, such as WWVB and MSF, the second synchronization, the minute synchronization, and the decoding of the code may also be performed.

Figure 20A:
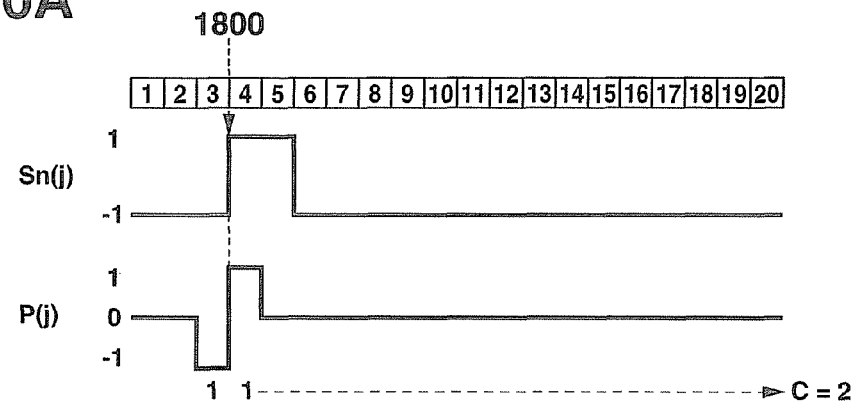
FIGS. 20A, 20B, and 20C are diagrams illustrating the covariance value between the input waveform data and the predicted waveform data.
Figure 20B:
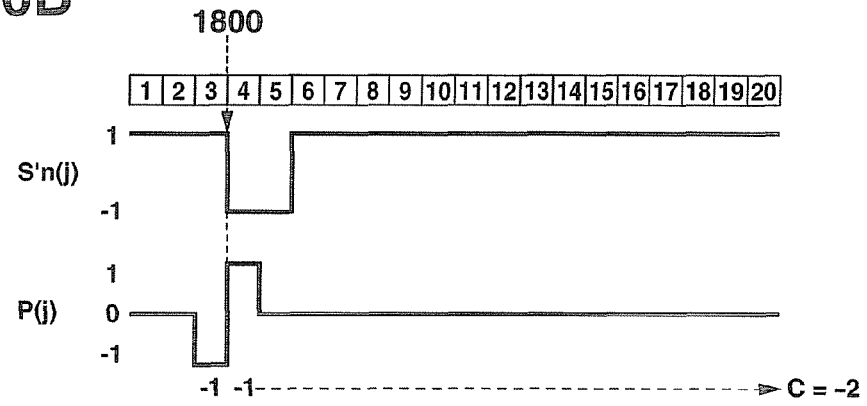
Figure 20C:
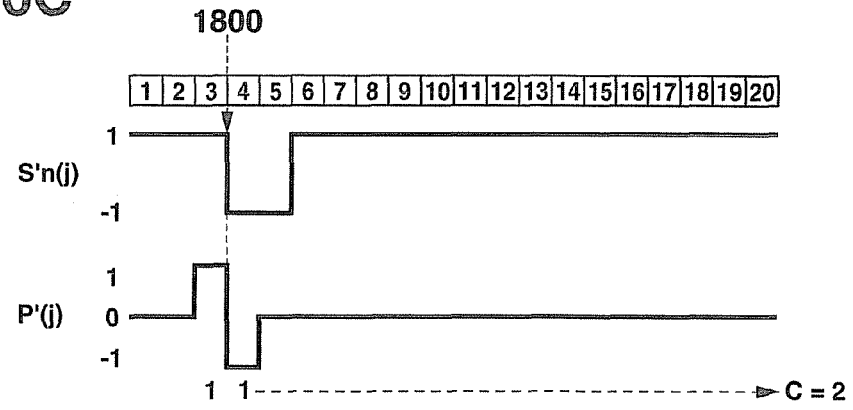

Next, second synchronization in WWVB or MSF will be described. As shown in FIGS. 7A to 7C and FIGS. 8A to 8E, in WWVB or MSF, a signal changes from a high level to a low level at the head of the second. As such, it is considered that the predicted waveform data used in JJY is applied to the signal that falls at the head. FIGS. 20A to 20C are diagrams illustrating the covariance value between the input waveform data and the predicted waveform data. In FIG. 20A, input waveform data Sn(j) changes from a low level to a high level at the head position of the second (see reference numeral 1800). The value of the covariance value C between the predicted waveform data P(j) that has the first value corresponding to a low level before the rising point and has the second value corresponding to a high level after the rising point and the input waveform data Sn(j) is 2 (maximum). For ease of explanation, the covariance value is simply the sum of the products between the data values of the predicted waveform data and the data values of the input waveform data.

As shown in FIG. 20B, input waveform data S'n(j) that changes from a high level to a low level at the head position of the second is considered. The value of the covariance value C between the input waveform data S'n(j) and the predicted waveform data P(j) is −2 (minimum). That is, as in WWVB or MSF, for the data that changes from a high level to a low level at the head position of the second, in order to detect the head position of the second, the minimum value of the covariance value may be selected as the optimal value in the process shown in FIG. 10.

Alternatively, as in WWVB or MSF, in order to detect the head position of the second in the data that changes from a high level to a low level at the head position of the second, another predicted waveform data, which is the inverted data of the predicted waveform data P(j), may be used. In FIG. 20C, the input waveform data S'n(j) is the same as that shown in FIG. 20B. Predicted waveform data P'(j) is the inverted data of the predicted waveform data P(j) shown in FIG. 20B. In this case, the covariance value C(2) when p is 2 is the maximum value (=2). Therefore, the head position of the second may be determined based on the predicted waveform data P(2) and the input waveform data Sn(2).

Figure 21A:
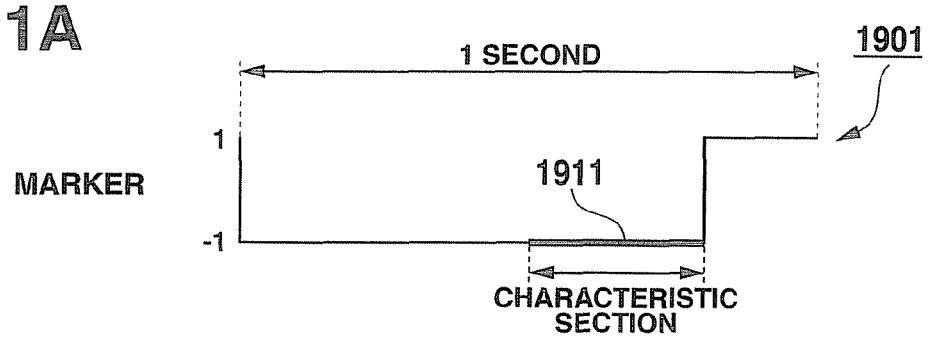
FIGS. 21A, 21B, and 21C are diagrams illustrating the characteristic section of each code in the WWVB standard.
Figure 21B:
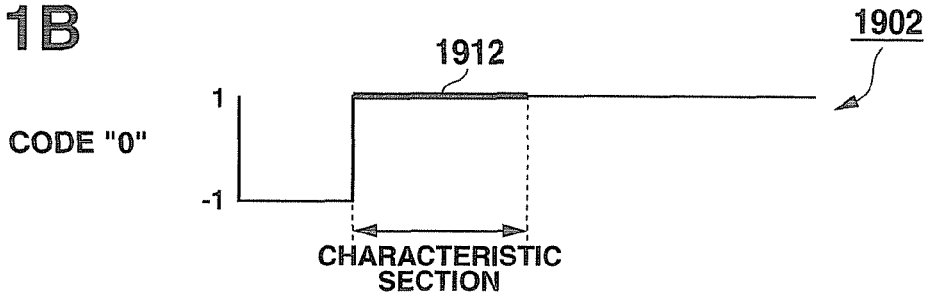
Figure 21C:
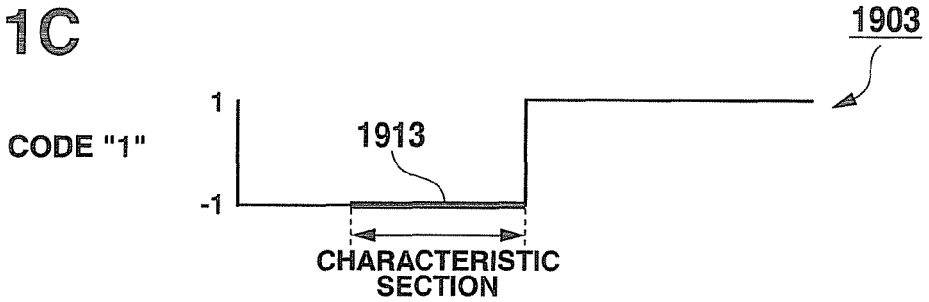
Figure 22A:
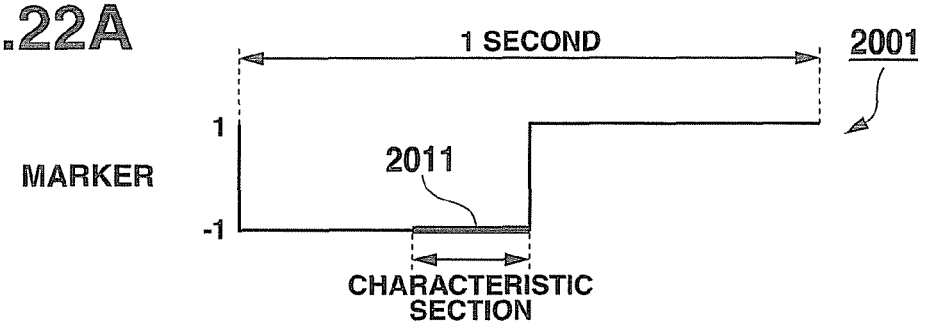
FIGS. 22A, 22B, 22C, 22D, and 22E are diagrams illustrating the characteristic section of each code in the MSF standard.
Figure 22B:
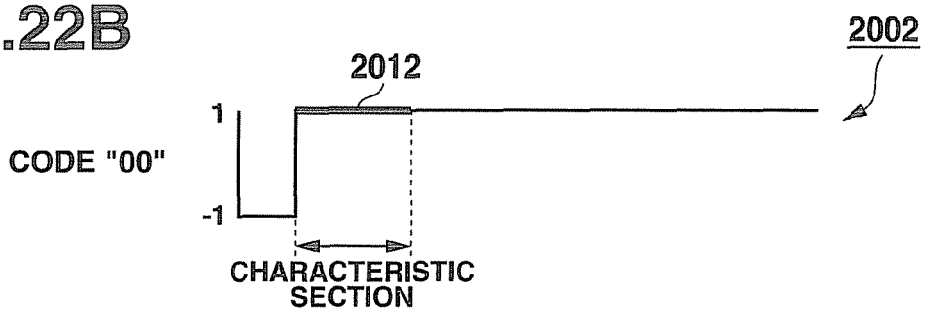
Figure 22C:
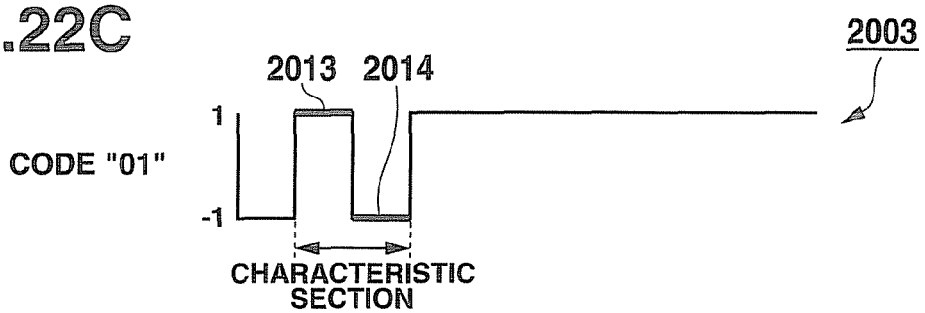
Figure 22D:
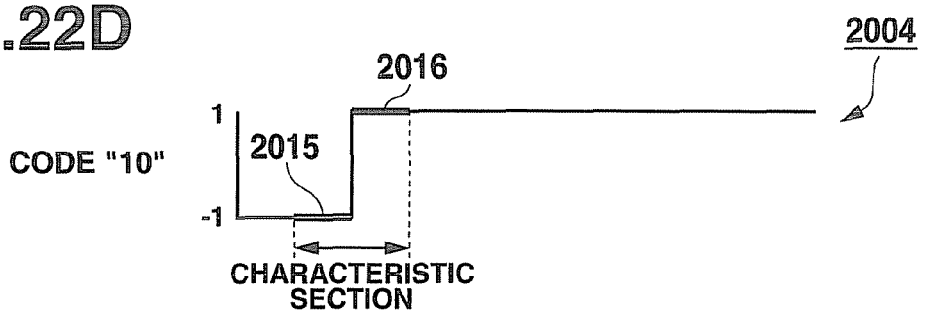
Figure 22E:
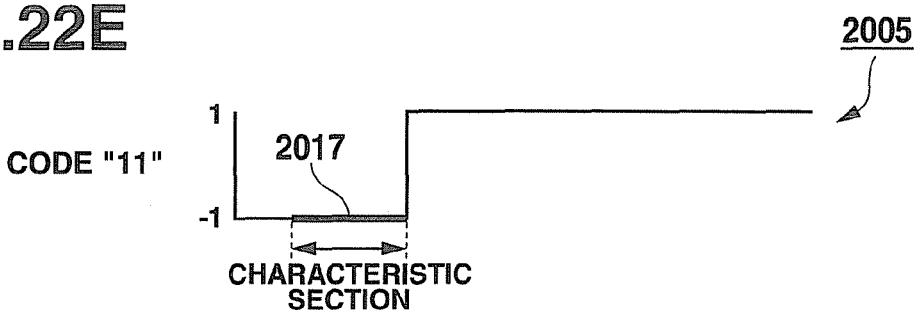

Next, minute synchronization and the decoding of a code in WWVB or MSF will be described. In WWVB, the data value in the characteristic section is extracted and only the data value of characteristic section is used to calculate the covariance value. FIGS. 21A to 21C are diagrams illustrating the characteristic section of each code in WWVB. For codes in WWVB, a marker (see reference numeral 1901) shown in FIG. 21A, a code 0 (see reference numeral 1902) shown in FIG. 21B, and a code 1 (see reference numeral 1903) shown in FIG. 21C have characteristic sections with different eigenvalues. The marker is at a low level (data value −1) and has an eigenvalue −1 different from those of other codes in the section (see reference numeral 1911) from 500 ms to 800 ms. In this embodiment, in WWVB, the section from 500 ms to 800 ms in the marker is the characteristic section. In addition, the data value of the characteristic section is −1 indicating a low level.

The code 0 is at a high level (data value 1) and has an eigenvalue 1 different from those of other codes in the section (see reference numeral 1912) from 200 ms to 500 ms. The code 1 is at a low level (data value −1) and has an eigenvalue −1 different from that of the code 0 in the section (see reference numeral 1913) from 200 ms to 500 ms. Therefore, in each of the codes 0 and 1, the section from 500 ms to 800 ms is the characteristic section. In addition, the data values of the characteristic sections are 1 and −1.

Similar to JJY, it is possible to perform the process of detecting the minute head position and the code decoding process using the data value of the characteristic section.

FIGS. 22A to 22E are diagrams illustrating the characteristic section of each code in MSF. For codes in MSF, a marker (see reference numeral 2001) shown in FIG. 22A, a code 00 (see reference numeral 2002) shown in FIG. 22B, a code 01 (see reference numeral 2003) shown in FIG. 22C, a code 10 (see reference numeral 2004) shown in FIG. 22D, and a code 11 (see reference numeral 2005) shown in FIG. 22E have sections with different eigenvalues.

The marker is at a low level (data value −1) and has an eigenvalue −1 different from those of other codes in the section (see reference numeral 2011) from 300 ms to 500 ms. In this embodiment, in MSF, the section from 300 ms to 500 ms in the marker is the characteristic section. In addition, the data value of the characteristic section is −1 indicating a low level.

The code 00 is at a high level (data value 1) and has an eigenvalue 1 different from those of other codes in the section (see reference numeral 2012) from 100 ms to 300 ms. The code 01 is at a high level (data value 1) in the section (see reference numeral 2013) from 100 ms to 200 ms and is at a low level (data value −1) in the section (see reference numeral 1014) from 200 ms to 300 ms. The code 01 has a combination of values (the first half is 1 and the second half is −1) different from those of other codes in the sections. The code 10 is at a low level (data value −1) in the section (see reference numeral 2015) from 100 ms to 200 ms and is at a high level (data value 1) in the section (see reference numeral 1016) from 200 ms to 300 ms. The code 10 has a combination of values (the first half is −1 and the second half is 1) different from those of other codes in the sections. The code 11 is at a low level (data value −1) and has an eigenvalue −1 different from those of other codes in the section (see reference numeral 2017) from 100 ms to 300 ms. Therefore, the section from 100 ms to 300 ms is the characteristic section. The data value of each of the sections is the same as that shown in FIG. 20.

In MSF, the data values of the characteristic sections of the codes 00 to 11 are not constant. For example, the data values of the first half and the second half of the characteristic section of the code 01 are 1 and −1, respectively. Therefore, in the code decoding process based on the MSF standard, similar to the detection of the minute head position, the data value in the characteristic section of the input waveform data may be multiplied by a corresponding data value in the characteristic section of the predicted waveform data, the calculated values may be added to obtain the total sum, and the covariance value may be calculated based on the obtained total sum. In this embodiment, the data value accumulator 29 accumulates the data value of the characteristic section, which has a constant and unique data value different from those of other codes, of each of the codes forming time information included in the time code in the input waveform data, for example, the codes 0 and 1 based on JJY and stores the accumulated value in the accumulated value buffer 30. The correlation value calculator 25 multiplies the data value of the characteristic section stored in the accumulated value buffer 30 by the characteristic value, which is the first value or the second value of the characteristic section of a specific code, for example, each of the codes 0 and 1 based on JJY and calculates the correlation values between the input waveform data and the codes based on the multiplied value. Originally, multiplication to calculate the correlation value needs to be performed between the data values of the sampling points of waveform data. However, the code has a constant and unique data value (characteristic value) different from those of other codes in the characteristic section. Therefore, the value obtained only by multiplying the accumulated value by the characteristic value indicates the correlation between the input waveform data and the code. As a result, it is possible to acquire an appropriate correlation value with a small amount of calculation.

In this embodiment, when the head position of the minute in the time code is specified based on the signal levels before and after the head position of the time code, the data value accumulator 29 accumulates the data value of a specific section and stores the accumulated value in the accumulated value buffer 30. When the minute head position is specified, the correlation value calculator 25 extracts the data value of the characteristic section corresponding to the code forming time information from the accumulated value buffer 30 based on the detected minute head position, and multiplies the data value by the characteristic value. Therefore, it is possible to acquire the accumulated value of the data value of the characteristic section while the minute head position is detected, and to start to specify the code forming time information immediately after the detection of the minute head position ends.

For example, in this embodiment, in the input waveform data, the data value of the second characteristic section, which has a constant and unique data value different from those of other codes, of a predetermined code with plural unit time lengths which includes the head position of the minute in the time codes, for example, two continuous codes P in JJY are acquired. The correlation value calculator 25 calculates the correlation value between the input waveform data and the predetermined code based on the value obtained by multiplying the data value of the second characteristic section in the acquired input waveform data by a characteristic value which is the first value or the second value of the characteristic section of the predetermined code with the plural unit time lengths which includes the head position of the minute.

According to the above-mentioned embodiment, it is possible to obtain the correlation value only by calculating the data value of the characteristic section in the detection of the minute head position. Therefore, it is possible to obtain an appropriate correlation value with a small amount of calculation.

For example, the first value is set to −1 and the second value is set to 1. The first value is multiplied by the first value or the second value is multiplied by the second value to obtain a first positive value 1 indicating a positive correlation. Meanwhile, the first value is multiplied by the second value to obtain a second negative value −1 indicating a negative correlation. Thus, the correlation value calculator 25 selects the maximum value of the correlation value as an optimal value. In this way, it is possible to specify a code with the highest correlation with the input waveform data.

In this embodiment, time information forming the time code is acquired and the current time is calculated based on the acquired time information. Therefore, it is possible to correct the time obtained by the internal timer with the calculated current time.

The invention is not limited to the above-described embodiment, but various modifications and changes of the invention can be made without departing from the scope and spirit of the invention. The modifications and changes are also included in the scope of the invention.

In the detection of the second pulse position according to the above-described embodiment, the predicted waveform data has the first value indicating a low level in a predetermined section (temporally old side) before a rising point from a low level to a high level and has the second value having a high level in a predetermined section (temporally new side) after the point. In addition, the predicted waveform data has a third value indicating 0 in sections other the predetermined sections before and after the point. However, the invention is not limited thereto. For example, sections other than the predetermined sections before and after the point may be excluded from calculation. That is, the predicted waveform data may have an indefinite or invalid value, not the third value 0, in sections other than the predetermined sections.

In this case, only the data of the predetermined sections before and after the changing point of the signal level of the predicted waveform data, that is, a point where the signal level changes from a low level to a high level is extracted, and the covariance values between the data values of the predetermined sections and the data values of the corresponding input waveform data are calculated. In FIG. 9, in the first predicted waveform data item P(1, j), the sections represented by reference numerals 711 and 712 are the predetermined sections. In the second predicted waveform data item P(2, j), the third predicted waveform data item P(3, j), the fourth predicted waveform data item P(4, j), . . . , and the twentieth predicted waveform data item P(20, j), the sections represented by reference numerals 721, 731, 741, . . . , and 751 are the predetermined sections.

According to the above-mentioned embodiment, it is possible to omit the calculation of the data value of the predicted waveform data and the data value of the input waveform data in sections other than the predetermined sections. Therefore, it is possible to reduce the number of calculations.

In the embodiment, in the detection of the second pulse position, the first value indicating the low level of the input waveform data and the predicted waveform data is −1, the second value indicating the high level thereof is 1, and the third value other than the first and second values is 0. In the detection of the minute head position and the decoding of the code, the first value indicating the low level of the input waveform data and the predicted waveform data is −1 and the second value indicating the high level thereof is 1. However, the invention is not limited to these values. The first value and the second value may be as follows.

(1) When the input waveform data indicates the first value and the predicted waveform data indicates the first value, or when the input waveform data indicates the second value and the predicted waveform data indicates the second value, the first value is multiplied by the first value or the second value is multiplied by the second value to obtain a predetermined positive value indicating a positive correlation. That is, when the input waveform data and the predicted waveform data indicate the same value, a predetermined positive value is obtained.

(2) When the input waveform data indicates the first value and the predicted waveform data indicates the second value, or when the input waveform data indicates the second value and the predicted waveform data indicates the first value, the first value is multiplied by the second value to obtain a predetermined negative value indicating a negative correlation. That is, when the input waveform data and the predicted waveform data indicate different values, a predetermined negative value is obtained. It is preferable that the predetermined negative value be opposite to the predetermined positive value in polarity.

In the calculation of the second pulse position, the third value may not be 0. However, the third value should not affect the correlation value, such as the covariance value, when it is multiplied by the first value or the second value.

In the above-described embodiment, the covariance value is used as the correlation value, but the invention is not limited thereto. For example, a residual, which is the total sum of the absolute values of differences, may be used as the correlation value. Alternatively, a mutual correlation coefficient may be used instead of the covariance or the residual.

In the above-described embodiment, in the detection of the minute head position, the data value in the characteristic section of Sn(i, j) is extracted so as to correspond to the characteristic section of the predicted waveform data (Step S1105 in FIG. 13). In the calculation of the covariance, the correlation value (covariance value) C(i) between the input waveform data Sn(i, j) in the characteristic section and the predicted waveform data P(j) in the characteristic section is calculated. However, the data value of the predicted waveform data may be multiplied by the corresponding data value of the input waveform data and the covariance value may be calculated based on the multiplied value, without extracting the data value in the characteristic section.

When the data value of the predicted waveform data is multiplied by the corresponding data value of the input waveform data to obtain a multiplied value, the amount of calculation increases, but it is possible to accurately specify input waveform data corresponding to the head position of the minute since the entire waveform is compared.

While the description above refers to particular embodiments of the present invention, it will be understood that many modifications may be made without departing from the spirit thereof. The accompanying claims are intended to cover such modifications as would fall within the true scope and spirit of the present invention. The presently disclosed embodiments are therefore to be considered in all respects as illustrative and not restrictive, the scope of the invention being indicated by the appended claims, rather than the foregoing description, and all changes that come within the meaning and range of equivalency of the claims are therefore intended to be embraced therein. For example, the present invention can be practiced as a computer readable recording medium in which a program for allowing the computer to function as predetermined means, allowing the computer to realize a predetermined function, or allowing the computer to conduct predetermined means.

What is claimed is:

1. A time information-acquiring apparatus comprising:

a receiver configured to receive a standard time radio wave including a time code;

an input waveform generator configured to sample a signal output from the receiver and including the time code with a predetermined sampling period and to generate input waveform data with one or more unit time lengths, the input waveform data at each sampling point having one of a first value indicating a low level and a second value indicating a high level, the input waveform data within a first characteristic section having a predetermined value unique to codes forming time information included in the time code;

an accumulator configured to accumulate the predetermined value of the input waveform data during the first characteristic section and to store an accumulated value;

a calculator configured to perform an arithmetic calculation for the accumulated value stored by the accumulator and characteristic values, which are one of the first value and the second value, of the first characteristic section of the codes forming the time information included in the time code, and to calculate correlation values between the input waveform data and the codes forming the time information based on a result of the arithmetic calculation;

a comparator configured to compare the correlation values calculated by the calculator and to determine an optimal value of the correlation values; and a controller configured to acquire the time information included in the time code based on a code related to the optimal value.

2. The time information-acquiring apparatus according to claim 1, wherein the accumulator is configured to accumulate the value of the input waveform data during the first characteristic section while a head position of a minute in the time code is detected based on signal levels at positions before and after a head position of the time code, and the calculator is configured to read the accumulated value from the accumulator based on a detected head position of a minute when the head position of a minute in the time code is detected and to perform the arithmetic calculation for a read value and the characteristic values.

3. The time information-acquiring apparatus according to claim 2, wherein the input waveform generator is configured to acquire data values of the input waveform data within a second characteristic section for codes with unit time lengths and including a head position of the time code, the data values being unique to the codes, the calculator is configured to perform the arithmetic calculation for the data values of the input waveform data within the second characteristic section acquired by the input waveform generator and characteristic values, which are one of the first value and the second value, of the second characteristic section of the codes, and to calculate second correlation values between the input waveform data and the codes based on a result of the arithmetic calculation;

the comparator is configured to compare the second correlation values calculated by the calculator and to determine a second optimal value of the second correlation values, and the controller is configured to determine the head position of a minute in the time code based on the input waveform data related to the second optimal value.

4. The time information-acquiring apparatus according to claim 3, wherein the result of the arithmetic calculation comprises a positive first correlation value indicating a positive correlation by performing an arithmetic operation between the first value of the input waveform data and the first value within the second characteristic section or between the second value of the input waveform data and the second value within the second characteristic section, and a negative second correlation value indicating a negative correlation by performing an arithmetic operation between the first value of the input waveform data and the second value within the second characteristic section or between the second value of the input waveform data and the first value within the second characteristic section, and the comparator is configured to compare the first and the second correlation values and to select a maximum value of the first and the second correlation values as the optimal value.

5. A radio wave timepiece comprising:

the time information-acquiring apparatus according to claim 3;

an internal timer configured to measure a current time using an internal clock;

a time corrector configured to correct the current time measured by the internal timer with the current time acquired by the controller in the time information-acquiring apparatus according to claim 1; and a display device configured to display the current time measured by the internal timer or corrected by the time corrector.

6. The time information-acquiring apparatus according to claim 2, further comprising:

a predicted waveform generator configured to generate predicted waveform data items with the one or more unit time lengths and including a head position of a minute in the time code, the predicted waveform data items at each sampling point having one of the first value and the second value, wherein the calculator is configured to multiply a data value of the input waveform data by data values of the predicted waveform data items and to calculate second correlation values between the input waveform data and the predicted waveform data items based on multiplied values, the comparator is configured to compare the second correlation values calculated by the calculator and to determine a second optimal value of the second correlation values, and the controller is configured to specify the head position of a minute in the time code based on the input waveform data related to the second optimal value.

7. The time information-acquiring apparatus according to claim 6, wherein the results of the arithmetic calculation comprises a positive first correlation value indicating a positive correlation by performing an arithmetic operation between the first value of the input waveform data and the first value within the first characteristic section or between the second value of the input waveform data and the second value within the first characteristic section, and a negative second correlation value indicating a negative correlation by performing an arithmetic operation between the first value of the input waveform data and the second value within the first characteristic section or between the second value of the input waveform data and the first value within the first characteristic section, and the comparator is configured to compare the first and the second correlation values and to select a maximum value of the first and the second correlation values as the optimal value.

8. A radio wave timepiece comprising:

the time information-acquiring apparatus according to claim 6;

an internal timer configured to measure a current time using an internal clock;

a time corrector configured to correct the current time measured by the internal timer with the current time acquired by the controller in the time information-acquiring apparatus according to claim 1; and a display device configured to display the current time measured by the internal timer or corrected by the time corrector.

9. The time information-acquiring apparatus according to claim 2, wherein the result of the arithmetic calculation comprises a positive first correlation value indicating a positive correlation by performing an arithmetic operation between the first value of the input waveform data and the first value within the first characteristic section or between the second value of the input waveform data and the second value within the first characteristic section, and a negative second correlation value indicating a negative correlation by performing an arithmetic operation between the first value of the input waveform data and the second value within the first characteristic section or between the second value of the input waveform data and the first value within the first characteristic section, and the comparator is configured to compare the first and the second correlation values and to select a maximum value of the first and the second correlation values as the optimal value.

10. A radio wave timepiece comprising:

the time information-acquiring apparatus according to claim 2;

an internal timer configured to measure a current time using an internal clock;

a time corrector configured to correct the current time measured by the internal timer with the current time acquired by the controller in the time information-acquiring apparatus according to claim 1; and a display device configured to display the current time measured by the internal timer or corrected by the time corrector.

11. The time information-acquiring apparatus according to claim 1, wherein the input waveform generator is configured to acquire data values of the input waveform data within a second characteristic section for codes with unit time lengths and including a head position of the time code, the data values being unique to the codes, the calculator is configured to perform the arithmetic calculation for the data values of the input waveform data within the second characteristic section acquired by the input waveform generator and characteristic values, which are one of the first value and the second value, of the second characteristic section of the codes, and to calculate second correlation values between the input waveform data and the codes based on a result of the arithmetic calculation;

the comparator is configured to compare the second correlation values calculated by the calculator and to determine a second optimal value of the second correlation values, and the controller is configured to determine the head position of a minute in the time code based on the input waveform data related to the second optimal value.

12. The time information-acquiring apparatus according to claim 11, wherein the result of the arithmetic calculation comprises a positive first correlation value indicating a positive correlation by performing an arithmetic operation between the first value of the input waveform data and the first value within the second characteristic section or between the second value of the input waveform data and the second value within the second characteristic section, and a negative second correlation value indicating a negative correlation by performing an arithmetic operation between the first value of the input waveform data and the second value within the second characteristic section or between the second value of the input waveform data and the first value within the second characteristic section, and the comparator is configured to compare the first and the second correlation values and to select a maximum value of the first and the second correlation values as the optimal value.

13. A radio wave timepiece comprising:

the time information-acquiring apparatus according to claim 11;

an internal timer configured to measure a current time using an internal clock;

a time corrector configured to correct the current time measured by the internal timer with the current time acquired by the controller in the time information-acquiring apparatus according to claim 1; and a display device configured to display the current time measured by the internal timer or corrected by the time corrector.

14. The time information-acquiring apparatus according to claim 1, further comprising:

a predicted waveform generator configured to generate predicted waveform data items with the one or more unit time lengths and including a head position of a minute in the time code, the predicted waveform data items at each sampling point having one of the first value and the second value, wherein the calculator is configured to multiply a data value of the input waveform data by data values of the predicted waveform data items and to calculate second correlation values between the input waveform data and the predicted waveform data items based on multiplied values, the comparator is configured to compare the second correlation values calculated by the calculator and to determine a second optimal value of the second correlation values, and the controller is configured to specify the head position of a minute in the time code based on the input waveform data related to the second optimal value.

15. The time information-acquiring apparatus according to claim 14, wherein the results of the arithmetic calculation comprises a positive first correlation value indicating a positive correlation by performing an arithmetic operation between the first value of the input waveform data and the first value within the first characteristic section or between the second value of the input waveform data and the second value within the first characteristic section, and a negative second correlation value indicating a negative correlation by performing an arithmetic operation between the first value of the input waveform data and the second value within the first characteristic section or between the second value of the input waveform data and the first value within the first characteristic section, and the comparator is configured to compare the first and the second correlation values and to select a maximum value of the first and the second correlation values as the optimal value.

16. A radio wave timepiece comprising:

the time information-acquiring apparatus according to claim 14;

an internal timer configured to measure a current time using an internal clock;

a time corrector configured to correct the current time measured by the internal timer with the current time acquired by the controller in the time information-acquiring apparatus according to claim 1; and a display device configured to display the current time measured by the internal timer or corrected by the time corrector.

17. The time information-acquiring apparatus according to claim 1, wherein the result of the arithmetic calculation comprises a positive first correlation value indicating a positive correlation by performing an arithmetic operation between the first value of the input waveform data and the first value within the first characteristic section or between the second value of the input waveform data and the second value within the first characteristic section, and a negative second correlation value indicating a negative correlation by performing an arithmetic operation between the first value of the input waveform data and the second value within the first characteristic section or between the second value of the input waveform data and the first value within the first characteristic section, and the comparator is configured to compare the first and the second correlation values and to select a maximum value of the first and the second correlation values as the optimal value.

18. A radio wave timepiece comprising:

the time information-acquiring apparatus according to claim 17;

an internal timer configured to measure a current time using an internal clock;

a time corrector configured to correct the current time measured by the internal timer with the current time acquired by the controller in the time information-acquiring apparatus according to claim 1; and a display device configured to display the current time measured by the internal timer or corrected by the time corrector.

19. A radio wave timepiece comprising:

the time information-acquiring apparatus according to claim 1;

an internal timer configured to measure a current time using an internal clock;

a time corrector configured to correct the current time measured by the internal timer with the current time acquired by the controller in the time information-acquiring apparatus according to claim 1; and a display device configured to display the current time measured by the internal timer or corrected by the time corrector.

20. A time information-acquiring apparatus comprising:

a receiver configured to receive a standard time radio wave including a time code;

an input waveform generator configured to sample a signal output from the receiver and including the time code with a predetermined sampling period and to generate input waveform data with one or more unit time lengths, the input waveform data at each sampling point having one of a first value indicating a low level and a second value indicating a high level, the input waveform data within a first characteristic section having a predetermined value unique to codes forming time information included in the time code;

an accumulator configured to accumulate the predetermined value of the input waveform data during the first characteristic section and to store an accumulated value;

a calculator configured to perform an arithmetic calculation for the accumulated value stored by the accumulator and characteristic values, which are one of the first value and the second value, of the first characteristic section of the codes forming the time information included in the time code, and to calculate correlation values between the input waveform data and the codes forming the time information based on a result of the arithmetic calculation;

a comparator configured to compare the correlation values calculated by the calculator and to determine an optimal value of the correlation values; and a controller configured to specify a head position of a minute in the time code based on an input waveform data related to the optimal value.

* * * * *